US012122437B1

(12) United States Patent
Gao et al.

(10) Patent No.: US 12,122,437 B1
(45) Date of Patent: Oct. 22, 2024

(54) CALCULATION METHOD OF LINE CARRYING CAPACITY OF REGIONAL RAPID RAIL TRANSIT UNDER MIXED OPERATION OF EXPRESS/LOCAL TRAINS

(71) Applicant: Beijing Urban Construction Design & Development Group CO. LTD., Beijing (CN)

(72) Inventors: Guofei Gao, Beijing (CN); Gangde Du, Beijing (CN); Han Zheng, Beijing (CN); Xiuquan Chen, Beijing (CN); Taoyuan Yang, Beijing (CN); Xuanchuan Zheng, Beijing (CN); Mingdian Chen, Beijing (CN); Zhen Wang, Beijing (CN)

(73) Assignee: BEIJING URBAN CONSTRUCTION DESIGN & DEVELOPMENT GROUP CO. LTD., Beijing (CN)

( * ) Notice: Subject to any disclaimer, the term of this patent is extended or adjusted under 35 U.S.C. 154(b) by 0 days.

(21) Appl. No.: 18/632,318

(22) Filed: Apr. 11, 2024

(30) Foreign Application Priority Data

Jun. 12, 2023 (CN) ..... 202310687380.X

(51) Int. Cl.
*B61L 27/16* (2022.01)

(52) U.S. Cl.
CPC ..... *B61L 27/16* (2022.01)

(58) Field of Classification Search
CPC ..... B61L 27/16
See application file for complete search history.

(56) References Cited

FOREIGN PATENT DOCUMENTS

| | | | |
|---|---|---|---|
| CN | 109670732 | * | 4/2019 |
| CN | 111178697 | * | 5/2020 |
| CN | 113743644 | * | 12/2021 |
| CN | 111882216 | * | 12/2023 |

OTHER PUBLICATIONS

CN 111882216 English Translation (Year: 2023).*
CN 113743644 English Translation (Year: 2021).*
CN 111178697 English Translation (Year: 2020).*
CN 109670732 English Translation (Year: 2019).*

* cited by examiner

*Primary Examiner* — Russell Frejd

(57) ABSTRACT

Provided is a calculation method of line carrying capacity of regional rapid rail transit under mixed operation of express/local trains. Based on the theory of calculating the line carrying capacity by analytical method and direct calculation method, a framework and ideas for calculating the line carrying capacity including two modes of a following operation mode and an overtaking operation mode are established. Taking the train stop interval time, additional time for starting and stopping, following interval time, express and local train numbers, an express/local train overtaking operation mode, overtaking station number, overtaking station position and other factors that affect the line carrying capacity as input, the line carrying capacity of the two modes is deduced and calculated respectively under the conditions of stopping the express train and not stopping the express train at the intermediate station.

11 Claims, 7 Drawing Sheets

CALCULATION METHOD OF LINE CARRYING CAPACITY OF REGIONAL RAPID RAIL TRANSIT UNDER MIXED OPERATION OF EXPRESS/LOCAL TRAINS

TECHNICAL FIELD

The disclosure relates to the technical field of operation of regional rapid rail transit lines, particularly to a calculation method of line carrying capacity of regional rapid rail transit under mixed operation of express/local trains.

BACKGROUND

Regional rapid rail transit, abbreviated as urban express rail, refers to a high-comfort express rail transit system within a metropolitan area. The urban express rail is used to connect urban areas with peripheral groups thereof, and adopts a flexible transportation organization mode with a large station spacing. The urban express rail is characterized by a higher running speed, a longer line and a larger distance between stations. Service targets of the urban express rail are mainly commuters and students who commute to and from residential areas, workplaces, commercial areas, and schools, and the service targets have definite demands for travel efficiency and service level. The urban express rail is an important transportation mode for building a regional multi-level and three-dimensional rail transit system, and the urban express rail is of great significance to supporting regional development. Typically, the urban express rail generally adopts transportation organization modes including all stations stop, also referred to as local train, and express/local train following operation mode. The all stations stop refers to a transportation organization mode where a train stops at every station during running of the train. For the all stations stop, because the train needs to stop at every station, a corresponding travel speed is slower, and the all stations stop is no longer suitable for a passenger flow demand of the urban express rail. The express/local train following operation mode is an operation organization technology that operates ordinary all stations stop trains and cross-station express trains according to the characteristics of long and short-distance passenger flow and a utilization situation of line carrying capacity, so that the transportation organization can adapt to the characteristics of passenger flow, and at the same time can meet the accessibility of short-distance passengers and the timeliness requirements of long-distance passengers, which can effectively reduce the travel time cost of passengers and the cost of enterprise operation, improve the service level, and better attract passengers. At the same time, there are great differences in technical standards, equipment and operation modes between foreign suburban railway systems and suburban railway systems in China, so a calculation method of line carrying capacity for the foreign suburban railway systems is not suitable for China's actual situation. However, not every station in China meets an overtaking condition, which is significantly different from high-speed and conventional railways in physical conditions, and its line carrying capacity cannot be determined by a calculation method of the high-speed and conventional railways. Therefore, in the actual design and operation process, it is difficult and urgent to determine the line carrying capacity of the express/local train following operation mode under the constraints of train following interval, express and local train pair number, overtaking station location, and station dwell time.

There are four main methods for calculating line carrying capacity of a regional rapid rail transit line: an analytical method, a direct calculation method, a coefficient removal method, and a graphic method.

1. Analytical Method

The analytical method mainly focuses on the analysis and algorithm based on a cycle of a train operation diagram, that is, determines the number of cycles that a line can be paved in a certain time range, and then calculates the line carrying capacity within the time range according to the number of trains in the cycle. The analytical method includes a utilization method and an average minimum train interval method. A formation mode of an urban rail train is single and an operation diagram of the urban rail train is highly homogeneous, therefore, the average minimum train interval method is often used to calculate the line carrying capacity.

The average minimum train interval method is a dynamic and uncertain method for calculating the line carrying capacity of high-speed railway lines, which pays attention to transportation quality. Based on the actual train operation, the average minimum train interval method calculates the line carrying capacity by studying train delay probability and train delay time and average minimum train interval time. Generally, the average minimum train interval method includes the following steps:

- step 1, dividing trains into train groups according to the types of the trains;
- step 2, determining a train number of each of the train groups and probability of occurrence of the same train group;
- step 3, determining an average minimum train interval time and minimum train interval time of each of the train groups;
- step 4, determining average train delay probability and average train delay time;
- step 5, determining average necessary buffer time; and
- step 6, calculating line carrying capacity, where the line carrying capacity=a time range to be calculated/(average minimum train interval time+the average necessary buffer time for a train operation diagram).

From the above analysis, it can be seen that the key to calculate the line carrying capacity by using the average minimum train interval method is to determine the average necessary buffer time and the average minimum train interval time. When the train operation diagram is available, these two parameters can be roughly determined by statistical data, and calculated results of the two parameters are more realistic. On the contrary, in the absence of the train operation diagram, estimated values of these two parameters can only be obtained by random probability method, so the calculated results are biased to a great extent.

Therefore, the average minimum train interval method is suitable for lines with train operation diagrams. In addition, because the parameters in the average minimum train interval method are always average values, the calculation results cannot reflect the interval characteristics when laying degrees of interval train lines are different.

2. Direct Calculation Method

In 2003, the Railway Research Institute introduced a direct calculation method, which is more closely related to the train operation diagram. According to the principle of time sharing and capacity sharing, the direct calculation method obtains a sum of minimum interval time that each train must occupy on the train operation diagram according to the different train arrangement and combination modes in the train operation diagram, and then directly calculates the line carrying capacity.

Although the direct calculation method avoids the intermediary of a removal coefficient, because it is based on the train operation diagram, the minimum interval time can only be obtained by studying the statistical laws of train types, train numbers and train distribution, so parameters of the direct calculation method are difficult to determine. In addition, because the direct calculation method calculates the line carrying capacity by taking a section as unit, it can't consider the influence of stopping and overtaking, so it is not suitable for the calculation of the line carrying capacity of the regional rapid rail transit line with a passenger flow section as unit.

3. Coefficient Removal Method

The coefficient removal method for the line carrying capacity of the regional rapid rail transit line follows a calculation method of line carrying capacity of a non-parallel train operation diagram of existing railways. Based on occupancy capacity of one train as a reference train, an equivalent relationship between other trains and the reference train in capacity occupation, that is, the so-called removal coefficient is determined, so that the occupation capacity of different trains is normalized to a standard train number, and a theoretical calculation value of the line carrying capacity is determined.

A removal coefficient of an urban express rail train is the capacity removal of stopping trains from non-stopping trains in a line section. When the coefficient removal method is used to calculate the line carrying capacity of the urban express rail line, on the basis of calculating line carrying capacity of an operation diagram of an all stations stop train of urban express rail, a train number corresponding to not working due to the influence of stop and speed difference is deducted, so as to calculate the line carrying capacity of an operation diagram of express/local train following operation mode of urban express rail.

Although the coefficient removal method for the line carrying capacity of the regional rapid rail transit line is relatively simple and practical, it often determines the removal coefficient on the basis of data statistics and diagrams, which leads to inaccurate calculation results and some deviations.

4. Graphic Method

A total train number that can be paved to the maximum extent on an operation diagram is a line carrying capacity of a non-parallel operation diagram of a section. The graphic method mainly includes two methods: a saturation method and a compression method.

The saturation method is based on a mathematical programming method, performs linear programming and mixed integer programming, introduces various intelligent algorithms. Based on an operation diagram with given initial conditions, a line carrying capacity is obtained by scheduling the largest number of trains, that is, paving the most running lines. Based on queuing theory, Occam's Razor method separates infrastructures of each line. When paving running lines, the trains arrive at a proposed infrastructure (it is assumed that the stock of trains entering the infrastructure is infinite at initialization) at the interval of minimum train following time with certain queuing rules. Therefore, the Occam's Razor method obtains the maximum line carrying capacity of each independent infrastructure, so the Occam's Razor method is also one of bottleneck analysis methods. The main disadvantage of the Occam's razor method is that it is difficult to determine an arrival interval and following interval change data after initialization, and the Occam's Razor method does not deal with all kinds of problems caused by random fluctuations in reality, and the total waiting time used is abstract, which is of little practical significance. The saturation method is to add running lines to the existing timetable as much as possible, so choosing a suitable train has become a key factor affecting the line carrying capacity.

International Union of Railways (UIC) 406 method is a highly recommended method for calculation and evaluation of line carrying capacity at present, and expected capacity of the operation diagram is given by using the Occam's razor rule. The UIC 406 method is based on a working plan rather than deterministic operation diagram, so it can review calculation results and evaluate a utilization degree of line carrying capacity by modifying various parameters of a system.

The graphic method is more accurate, however, it is time-consuming and laborious because of its large workload, and it only reflects the results rather than a process, so it is difficult to analyze influencing factors. Generally, it is only used for graphic checking when the utilization degree of line carrying capacity is close to saturation or individual special circumstances.

Therefore, in view of the above-mentioned defects, the designer of the disclosure, through painstaking research and design, and combining the experience and achievements in related industries for many years, has researched and designed a calculation method of line carrying capacity of an regional rapid rail transit line based on express/local train following operation mode.

SUMMARY

An objective of the disclosure is to provide calculation method of line carrying capacity of regional rapid rail transit under mixed operation of express/local trains. On the basis of the line carrying capacity calculation theory of analytical method and direct calculation method, a line carrying capacity calculation framework and ideas including two modes of following operation and overtaking are established. Taking the train stop interval time, additional time for starting and stopping, following interval time, the number of lines for express and local trains, the overtaking manner for the express and local trains, the number and location of overtaking stations and other factors that affect the line carrying capacity as input, the line carrying capacity of the two modes of following operation and overtaking is reasoned and calculated by the way of structural reasoning of the train diagram under the conditions of stop and non-stop of the express train.

In order to achieve the above objective, the disclosure discloses a calculation method of line carrying capacity of regional rapid rail transit under mixed operation of express/local trains, which includes:

step 1, inputting basic parameters, the basic parameters include:

line parameters, including: a station number m of stations; a station serial number i of each station, which satisfies $\{i|1\leq i\leq m, i\in N^+\}$; a section serial number j of each section, which satisfies $\{j|1\leq j\leq m-1, j\in N^+\}$; an overtaking station serial number $n_x$; an overtaking station serial number set W, which satisfies $n_x\in W$; and an overtaking station number x, which is a total number of an overtaking station in the overtaking station serial number set W;

operation scheme parameters, including: an express train number q, a local train number p, and a ratio q:p of express/local trains; and time parameters, including: minimum arrival-through interval time $h^{at}$; minimum through-departure interval time $h^{td}$; minimum departure-arrival interval time $h^{da}$; minimum arrival interval time $h^{aa}$; minimum departure interval time $h^{dd}$; an express/local train operation time difference $\Delta t_j$ at a j-th section; local train stop interval time $t_i^{st}$ at a station i; and express train stop interval time $t_i^{se}$ at the station i;

step 2, selecting an express/local train mixed operation mode as an express/local train following operation mode or an express/local train alternatively running and overtaking operation mode; and in response to the selection of the express/local train following operation mode, performing step 3, or in response to the selection of the express/local train alternatively running and overtaking operation mode, performing step 4;

step 3, determining whether an express/local train operation scheme under the express/local train following operation mode is an express/local train alternative operation scheme or an express train continuous departure scheme; and in response to the express/local train operation scheme being the express/local train alternative operation scheme, performing step 3.1, or in response to the express/local train operation scheme being the express train continuous departure scheme, performing step 3.2;

step 3.1, calculating express/local train mixed operation cycle time $T_a$ according to a formula (4) expressed as follows, and performing step 5, $$T_a = \begin{cases} a\left(h^{aa} + h^{dd}\right) + (p-q)h^{da} + q\left(\sum_{i=2}^{m-1} t_i^{st} + \sum_{j=1}^{m-1} \Delta t_j\right) + (p-q)t_{m-1}^{st} & \text{when } 1 \le q \le p; \\ ph^{aa} + qh^{dd} + p\left(\sum_{i=2}^{m-1} t_i^{st} + \sum_{j=1}^{m-1} \Delta t_j\right) & \text{when } 1 \le p < q \end{cases} \quad (4)$$

step 3.2, calculating express/local train mixed operation cycle time $T_b$ according to a formula (5) expressed as follows, and performing step 5, $$T_b = qh^{dd} + (p-1)h^{da} + h^{aa} + \sum_{i=2}^{m-1} t_i^{st} + \sum_{j=1}^{m-1} \Delta t_j + (p-1)t_{m-1}^{st}; \quad (5)$$

step 4, determining the overtaking station number x according to the overtaking station serial number set W under the express/local train alternatively running and overtaking operation mode; and in response to the overtaking station number x being less than 4, performing step 4.1; or in response to the overtaking station number x being not less than 4, performing step 4.2;

step 4.1, calculating express/local train mixed operation cycle time $T_c$ according to a formula (15) expressed as follows, and performing step 5, $$T_c = \max\{T_{n_x}\} = \max\{qh^{dd} + (p-q)(t_{n_x}^{st} + h^{da}) + qf_x(W, n_x)\} \quad (15);$$

step 4.2, dividing a line into multiple sections according to objective factors including line condition, an overtaking station position, and train routing, to make an overtaking station number in each section of the multiple sections be not larger than three, dividing of the multiple sections follows principles of less division times and relatively balanced division; and performing step 4.1;

step 5, determining whether an express train stops or not at an intermediate station according to the line parameters; in response to the express train only stopping at starting and terminal stations, taking the express/local train mixed operation cycle time as final express/local train mixed operation cycle time, performing step 7; or in response to the express train stopping at the intermediate station, performing step 6;

step 6, correcting the calculated express/local train mixed operation cycle time, based an express train stop position, according to formula (16) expressed as follows to obtain corrected express/local train mixed operation cycle time as final express/local train mixed operation cycle time; and performing step 7, $$g(i) = \begin{cases} h^{da} - h^{dd} - \Delta t_1, \ i = 2 \\ h^{da} - h^{aa} - \Delta t_{m-2}, \ i = m-1 \\ \left(h^{aa} + h^{dd} + t_{n_1}^{se}\right) - \left(h^{at} + h^{td}\right), \ i = n_x \\ h^{da} - h^{at} + t_{n_1-1}^{se} - \Delta t_{n_1-1}, \ i = n_x - 1 \\ h^{da} - h^{td} + t_{n_1+1}^{se} - \Delta t_{n_1}, \ i = n_x + 1 \\ -\sum t_i^{se}, \ \text{i for other values} \end{cases}; \quad (16)$$

step 7, calculating, based on the final express/local train mixed operation cycle time, the line carrying capacity under the express/local train mixed operation mode according to a formula (1):

$$N = 3600(p+q)/T \quad (1).$$

In an embodiment, in the step 3, in a situation that the express train number q is not greater than the local train number p, when express trains are inserted in a train operation diagram during interval time between express/local train alternative operation, the express/local train mixed operation cycle time are divided into three parts: express/local train departure interval time $h^{el}$, local-local train departure interval time $h^{ll}$, and local-express train departure interval time $h^{le}$; the express/local train departure interval time $h^{el}$ and the local-express train departure interval time $h^{le}$ are generated owing to inserting of the express trains; when the express train number q is increased by 1 unit, the express/local train departure interval time $h^{el}$ and the local-express train departure interval time $h^{le}$ are each increased by 1 unit; the number of the local-local train departure interval time $h^{ll}$ is related to the express train number q and the local train number p; the number of the local-local train departure interval time $h^{ll}$ in one express/local train mixed operation cycle time is (p−1), due to the inserting of the express trains, $h^{ll}$ is decomposed into $h^{el}$ and $h^{le}$; and when the express train number q is increased by 1 unit, the number of the local-local train departure interval time $h^{ll}$ is reduced by 1 unit;

in a situation that the express train number q is not greater than the local train number p, when express trains are inserted in a train operation diagram under the express train continuous departure scheme; an express-express train departure interval time $h^{ee}$ is added, the number of the express-express train departure interval time $h^{ee}$ in one express/local train mixed operation cycle time is (q−1);

in a situation of p≥q, the express/local train mixed operation cycle time, the local train number p and the express train number q are obtained through a formula (2) expressed as follows:

$$T=\begin{cases} q(h^{el}+h^{le})+(p-q)h^{ll} & \text{Under express/local train alternative operation scheme} \\ (q-1)h^{ee}+(p-1)h^{ll}+h^{el}+h^{le} & \text{Under express train continuous departure scheme} \end{cases} \quad (2)$$

in a situation of p<q, the express/local train mixed operation cycle time, the local train number p and the express train number q are obtained through a formula (3) expressed as follows:

$$T=\begin{cases} q(h^{el}+h^{le})+(p-q)h^{ee} & \text{Under express/local train alternative operation scheme} \\ (q-1)h^{ee}+(p-1)h^{ll}+h^{el}+h^{le} & \text{Under express train continuous departure scheme} \end{cases}. \quad (3)$$

In an embodiment, the step 4 further includes:

constraining express/local train departure interval time $h_{n_x}^{le}$ for overtaking station, express/local train departure interval time $h_1^{le}$ for a starting station is changed;

performing a derivation process from the express/local train departure interval time $h_1^{le}$ for the starting station;

taking a first overtaking station as a capacity calculation control point, determining $h_{n_1}^{le}=h^{at}+h^{da}$ based on a compact running principle, and obtaining the express/local train departure interval time $h_1^{le}$ and express/local train departure interval time $h_{n_1}^{le}$ for the first overtaking station through a formula (6) expressed as follows:

$$h_{n_1}^{le}=h_1^{le}-\sum_{i=2}^{n_1-1}t_i^{st}-\sum_{j=1}^{n_1-1}\Delta t_j+h^{da}; \quad (6)$$

substituting $h_{n_1}^{le}=h^{at}+h^{da}$ into the formula (6) to thereby obtain a formula (7) expressed as follows:

$$h_1^{le}=h^{at}+\sum_{i=2}^{n_1-1}t_i^{st}+\sum_{j=1}^{n_1-1}\Delta t_j;\text{ and} \quad (7)$$

obtaining express/local train mixed operation cycle time under taking the first overtaking station as the capacity calculation control point through a formula (8) expressed as follows:

$$T_{n_1}=qh^{dd}+(p-q)(t_{n_1}^{st}+h^{da})+q\left(h^{at}+\sum_{i=2}^{n_1-1}t_i^{st}+\sum_{j=1}^{n_1-1}\Delta t_j\right). \quad (8)$$

In an embodiment, in the step 4, in a situation that the overtaking station number is increased to 2, $h_{n_1}^{le}$ no longer only depends on $h^{at}$ and $h^{da}$, but also depends on express/local train departure interval time $h_{n_2}^{le}$ for a second overtaking station;

the step 4 further includes:

determining $h_{n_2}^{le}=h^{at}+h^{da}$ based on the compact running principle, and obtaining a formula (9) expressed as follows:

$$h_{n_2}^{le}=h_{n_1}^{le}-\sum_{i=n_1+1}^{n_2-1}t_i^{st}-\sum_{j=n_1}^{n_2-1}\Delta t_j+h^{da}; \quad (9)$$

substituting $h_{n_2}^{le}=h^{at}+h^{da}$ into the formula (9) to thereby obtain a formula (10) expressed as follows:

$$h_{n_1}^{le}=h^{at}+\sum_{i=n_1+1}^{n_2-1}t_i^{st}+\sum_{j=n_1}^{n_2-1}\Delta t_j; \quad (10)$$

performing an iterating process on $h_{n_1}^{le}$ and thereby obtaining express/local train mixed operation cycle time under taking the second overtaking station as the capacity calculation control point through a formula (11) expressed as follows:

$$T_{n_2}=qh_1^{le}+(p-q)(t_{n_2}^{st}+h^{da})++ q\left(h^{at}+\sum_{i=2}^{n_1-1}t_i^{st}+\sum_{j=1}^{n_1-1}\Delta t_j+\sum_{i=n_1+1}^{n_2-1}t_i^{st}+\sum_{j=n_1}^{n_2-1}\Delta t_j-h^{da}\right). \quad (11)$$

In an embodiment, in the step 4, in a situation that the overtaking station number is increased to x, express/local train departure interval time $h_{n_1}^{le}$, $h_{n_2}^{le}$, . . . , $h_{n_{x-1}}^{le}$ are affected;

the step 4 further includes:

performing mathematical induction based on a derivation process to determine $h_{n_x}^{le}=h^{at}+h^{da}$, and obtaining a relationship between $h_{n_x}^{le}$ and $h_{n_{x-1}}^{le}$ through a formula (12) expressed as follows:

$$h_{n_x}^{le}=h_{n_{x-1}}^{le}-\sum_{i=n_{x-1}+1}^{n_x-1}t_i^{st}-\sum_{j=n_{x-1}}^{n_x-1}\Delta t_j+h^{da}; \quad (12)$$

repeatedly performing an iterating process from $h_{n_{x-1}}^{le}$ to $h_1^{le}$ to thereby obtain express/local train mixed operation cycle time under taking an x-th overtaking station as the capacity calculation control point through a formula (13) expressed as follows:

$$T_{n_x}=qh_1^{le}+(p-q)(t_{n_x}^{st}+h^{da})++q\left[h^{at}+\sum_{i=2}^{n_1-1}t_i^{st}+\sum_{j=1}^{n_1-1}\Delta t_j+\ldots+\sum_{i=n_{x-1}+1}^{n_x-1}t_i^{st}+\sum_{j=n_x-1}^{n_x-1}\Delta t_j-(x-1)h^{da}\right]; \quad (13)$$

determining a minimum control point cycle function $f_x(W, n_x)$ expressed in a formula (14):

$$f_x(W, n_x)=h^{at}+\sum_{i=2}^{n_x}t_i^{st}+\sum_{j=1}^{n_x-1}\Delta t_j-\sum_{n_x\in W}t_{n_x}^{st}-(x-1)h^{da}; \quad (14)$$

in a situation that multiple overtaking stations are set on the line, comparing carrying capacities of the multiple overtaking stations to determine a control point affecting the line carrying capacity; and calculating the express/local train mixed operation cycle time $T_c$ under the express/local train mixed operation mode according to a formula (15) expressed as follows:

$$T_c=\max\{T_{n_x}\}=\max\{qh^{dd}+(p-q)(t_{n_x}^{st}+h^{da})+qf_x(W,n_x)\} \quad (15).$$

In an embodiment, an express train stop position divided into four categories: stopping at a second station or an (m−1)-th station; stopping at a front or back station of an overtaking station; stopping at the overtaking station; stopping at other intermediate station; the calculation method further includes: based on the express train stop position, introducing a cycle time calculation correction term g(i) considering the express train stop position.

In an embodiment, the calculation method further includes: in a situation that the category of the express train stop position is stopping at the second station or the (m−1)-th station, deriving express/local train mixed operation cycle time T' according to express/local train mixed operation cycle time T under a situation of express train not stopping at the intermediate station, under a situation of express train not stopping at the intermediate station, the capacity calculation control point depends on express/local train departure interval time $h^{dd}$ at a starting station and express/local train arrival interval time $h^{aa}$ at a terminal station, and the express/local train mixed operation cycle time T under a situation of express train not stopping at the intermediate station is $$T = h^{dd} + h^{aa} + \sum_{i=2}^{m-1} t_i^{st} + \sum_{j=1}^{m-1} \Delta t_j;$$

in a situation that the category of the express train stop position is stopping at the second station, the express/local train departure interval time $h^{dd}$ at the starting station is changed to express/local train departure-arrival interval time $h^{da}$ at the second station, the express/local train mixed operation cycle time $$T' \text{ is } T' = h^{da} + \sum_{i=2}^{m-1} t_i^{st} + \sum_{j=2}^{m-1} \Delta t_j + h^{aa},$$

and $$g(2) = T' - T = h^{da} - h^{dd} - \Delta t_1;$$

in a situation that the category of the express train stop position is stopping at the (m−1)-th station, the express/local train arrival interval time $h^{aa}$ at the terminal station is changed to express/local train departure-arrival interval time $h^{da}$ at the (m−1)-th station, the express/local train mixed operation cycle time $$T' \text{ is } T' = h^{da} + \sum_{i=2}^{m-1} t_i^{st} + \sum_{j=1}^{m-2} \Delta t_j + h^{dd},$$

and $$g(m-1) = T' - T = h^{da} - h^{aa} - \Delta t_{m-2}.$$

In an embodiment, the calculation method further includes: in a situation that the category of the express train stop position is stopping at the overtaking station, determining express/local train mixed operation cycle time T' by subtracting express/local train arrival-through interval time $h^{at}$ at an $n_x$-th station and express/local train through-departure interval time $h^{td}$ at the $n_x$-th station from express/local train mixed operation cycle time T under a situation of express train not stopping at the intermediate station and adding express/local train departure interval time $h^{dd}$ at the $n_x$-th station, express/local train arrival interval time $h^{aa}$ at the $n_x$-th station, and express train stop interval time $t_{n_x}^{se}$ at the $n_x$-th station, thereby obtaining $$T'=T-(h^{at}+h^{td})+(h^{aa}+h^{dd}+t_{n_x}^{se}) \text{ and } g(n_x)=T'-T=(h^{aa}+h^{dd}+t_{n_x}^{se})-(h^{at}+h^{td}).$$

In an embodiment, the calculation method further includes: in a situation that the category of the express train stop position is stopping at the $(n_x-1)$-th station, determining express/local train mixed operation cycle time T' by subtracting express/local train arrival-through interval time $h^{at}$ at an $n_x$-th station and an express/local train operation time difference $\Delta t_{n_{x-1}}$ at an $(n_{x-1})$-th section from express/local train mixed operation cycle time T without stopping of the express train and adding express/local train departure-arrival interval time $h^{da}$ at the $(n_x-1)$-th station, thereby obtaining $T'=T-h^{at}-\Delta t_{n_{x-1}}+h^{da}+t_{n_{x-1}}$ and $g(n_x-1)=T'-T=h^{da}-h^{at}+t_{n_{x-1}}-\Delta t_{n_{x-1}}$;

in a situation that the category of the express train stop position is stopping at an $(n_x+1)$-th station, determining express/local train mixed operation cycle time T' by subtracting express/local train through-departure interval time $h^{td}$ at the $n_x$-th station and an express/local train operation time difference $\Delta t_{n_x}$ at an $n_x$-th section from express/local train mixed operation cycle time T without stopping of the express train and adding express/local train departure-arrival interval time $h^{da}$ at the $(n_x+1)$-th station, thereby obtaining $T'=T-h^{td}-\Delta t_{n_x}+h^{da}+t_{n_{x+1}}^{se}$ and $g(n_x+1)=T'-T=h^{da}-h^{td}+t_{n_{x+1}}^{se}-\Delta t_{n_x}$.

In an embodiment, the calculation method further includes: in a situation that the category of the express train stop position is stopping at other intermediate station, determining express/local train mixed operation cycle time T' by subtracting total express train stop interval time $\Sigma t_i^{se}$ from express/local train mixed operation cycle time T under a situation of express train not stopping at the intermediate station, thereby obtaining $T'=T-\Sigma t_i^{se}$ and $g(i)=-\Sigma t_i^{se}$.

In an embodiment, the calculation method further includes: sending the line carrying capacity to a designer of the line, thereby designing, by the designer, a train operation manner of the line based on the line carrying capacity.

From the above, it can be seen that the calculation method of line carrying capacity of regional rapid rail transit under mixed operation of express/local trains of the disclosure at least has the following effects.

(1) The technical problem of poor compatibility of calculation method of line carrying capacity of regional rapid rail transit under mixed operation of express/local trains facing complex train operation scheme is solved.

There are two modes of express/local train mixed operation mode: a following operation mode and an overtaking operation mode. Further, departure manner of express and local trains can also be divided into two modes: express/local train alternative operation scheme and express train continuous departure scheme. Aiming at a variety of express and local train operation modes, based on the theoretical research of analytical method and direct calculation method, the disclosure establishes a calculation framework for the line carrying capacity of the two modes under the conditions of stopping the express train and not stopping the express train at the intermediate station, by disassembling the main factors that affect the line carrying capacity, as the train stop interval time, additional time for starting and stopping, following interval time, express and local train numbers, an express/local train overtaking operation mode, overtaking station number, overtaking station position and other factors, and performing structural reasoning of operation diagram.

(2) The disclosure solves the technical problem that it is difficult to calculate the express/local train mixed operation cycle time with different running ratios.

Traditional calculation methods of line carrying capacity, such as the analytical method, the direct calculation method and the coefficient removal method, are difficult to determine the parameters, the calculation results can not reflect the running characteristics of trains, and the calculation results can not reflect the influence of different working conditions on line carrying capacity, such as stopping and overtaking of express and local trains. Therefore, the disclosure comprehensively considers all kinds of time factors and stop schemes of express and local trains through the way of structural reasoning of the train operation diagram, constructs the quantitative relationship between the express/local train mixed operation cycle time and local trains and the interval time of all kinds of trains, and puts forward the calculation control function of the overtaking station capacity in the overtaking operation mode. Aiming at the express train stop position, express train stop time and other situations, the disclosure provides a cycle time correction function, which can efficiently solve the cycle time calculation problem under trains with different stop schemes and different operating ratios.

The details of the disclosure can be obtained from the following description and the attached drawings.

DETAILED DESCRIPTION OF EMBODIMENTS

According to a passenger flow structure of a line, it is necessary to run express and local trains to meet the demand of the rapid arrival of some passengers, that is, under conditions where the line carrying capacity is sufficient to meet demands, a train is planned to skip certain stations, thereby enhancing traveling speeds. However, this operation mode is difficult on a line with larger passenger flow and higher train density, because an express train not stopping at certain stations would eventually catch up with preceding trains at some point. In order to realize the express/local train mixed operation mode, there are currently two modes of transportation organization: a first mode is that each station is not provided with an overtaking line, and the express and local trains are operated by a following operation mode; and a second mode is that some stations are provided with overtaking lines, and the express and local trains are operated in an overtaking operation mode.

A calculation idea of line carrying capacity under express/local train following operation mode is as follows: it is assumed that a combined cycle time of express/local trains is T, and in the combined cycle time of express/local trains, an express train number is p, and a local train umber is q, then a line carrying capacity N under express/local train following operation mode is expressed through a formula (1):

$$N=3600(p+q)/T \quad (1).$$

Therefore, when calculating the line carrying capacity, how to determine a minimum unit cycle time T of express/local trains is a core problem. The passenger flow structure determines a combination structure of the express/local trains, the express train number, and the local train number. On this premise, based on a structure of the train operation diagram, a reasonable and intuitive calculation method of the line carrying capacity is established according to a line condition, a running sequence of the express/local trains, interval time of each type of trains, stop interval time and other factors, and this method does not need to use the removal coefficient. That is to say, first, the number of a train operation diagram cycle time run in a peak hour is determined, and then the number is multiplied by the number of train pairs or a train number contained in the train operation diagram cycle time. However, it is difficult to determine the train operation diagram cycle time under different running modes and conditions of the express and local trains.

Figure 1:
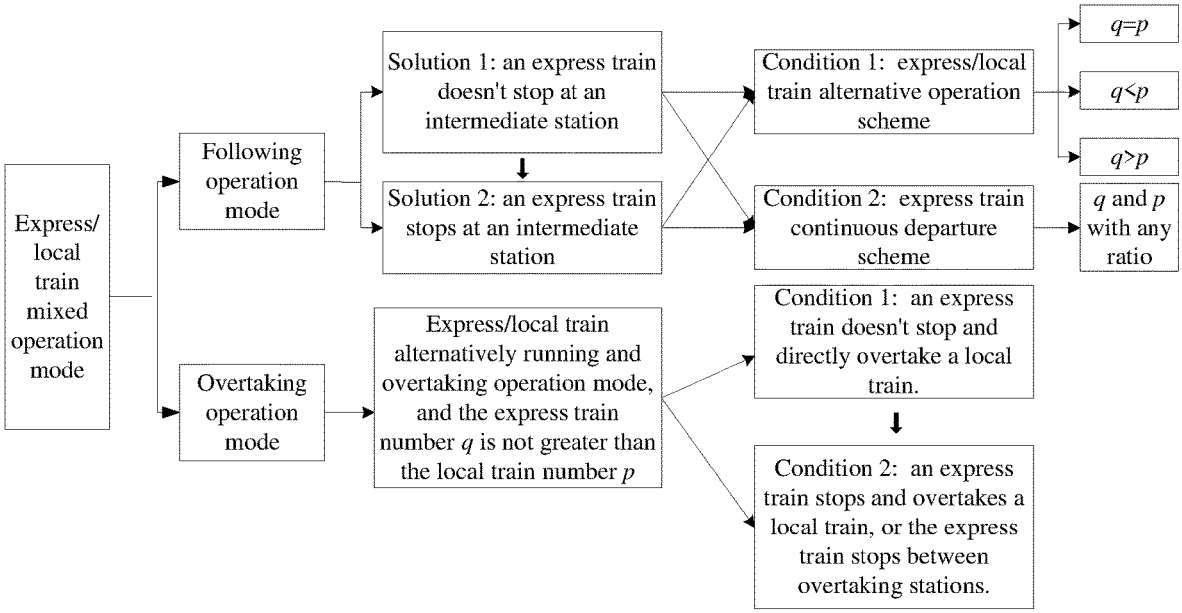
FIG. 1 illustrates a schematic frame diagram of a calculation method of line carrying capacity of regional rapid rail transit under mixed operation of express/local trains according to an embodiment of the disclosure.

The disclosure studies a line carrying capacity and its calculation method in two modes of following operation and overtaking operation. For the following operation mode, the primary research focuses on a calculation method of the line carrying capacity under different operation schemes and varying number ratios of express/local trains when considering two scenarios for an express train: one where the express train stops at an intermediate station, and another where the express train does not stop at the intermediate station. For the overtaking operation mode, the primary research focuses on a calculation method of the line carrying capacity under two kinds of overtaking operations: stopping at an overtaking station and non-stopping at the overtaking station of express trains under the scheme that express and local trains operate alternately and the express train number is not greater than the local train number. The operation scheme of mixed operation of express/local trains studied in the disclosure is illustrated in FIG. 1.

Figure 2A:
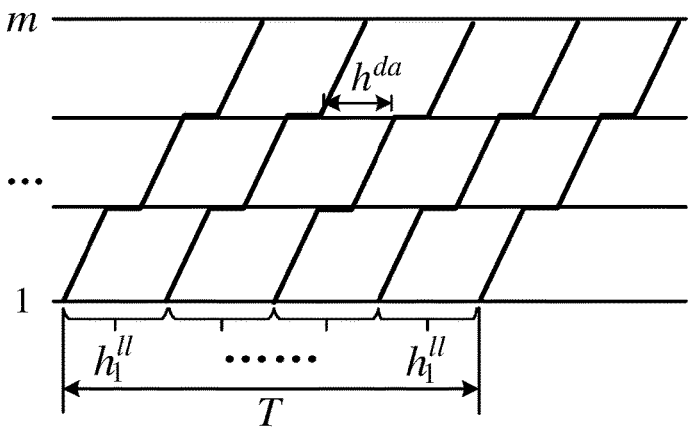
FIG. 2A illustrates a parallel train operation graph under mixed operation of express/local trains according to an embodiment of the disclosure.

In the calculation method of line carrying capacity of regional rapid rail transit under mixed operation of express/local trains, firstly, a quantitative relationship between operation cycle time and interval time under mixed operation of express/local trains is analyzed, and the calculation and analysis of the operation cycle time under mixed operation of express/local trains will be carried out on the basis of an operation diagram for all stations stop. FIG. 2A illustrates an operation diagram for all stations stop, and its minimum period time is determined by local-local train departure interval time $h^{ll}$.

Figure 2B:
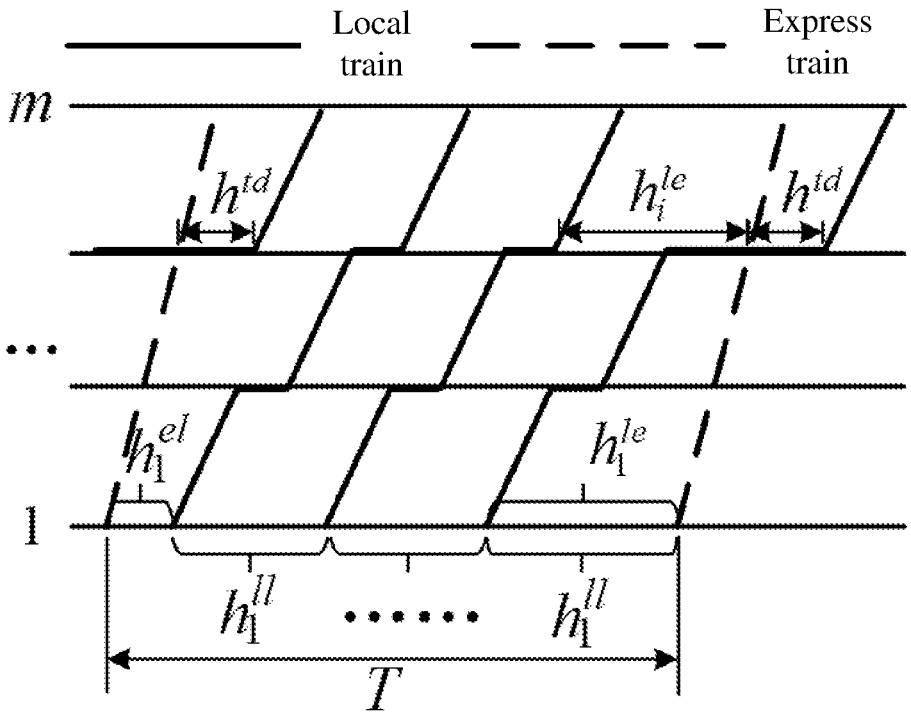
FIG. 2B illustrates a schematic diagram under mixed operation of express/local trains according to an embodiment of the disclosure, in which an express train number is 1, and p>q.
Figure 2C:
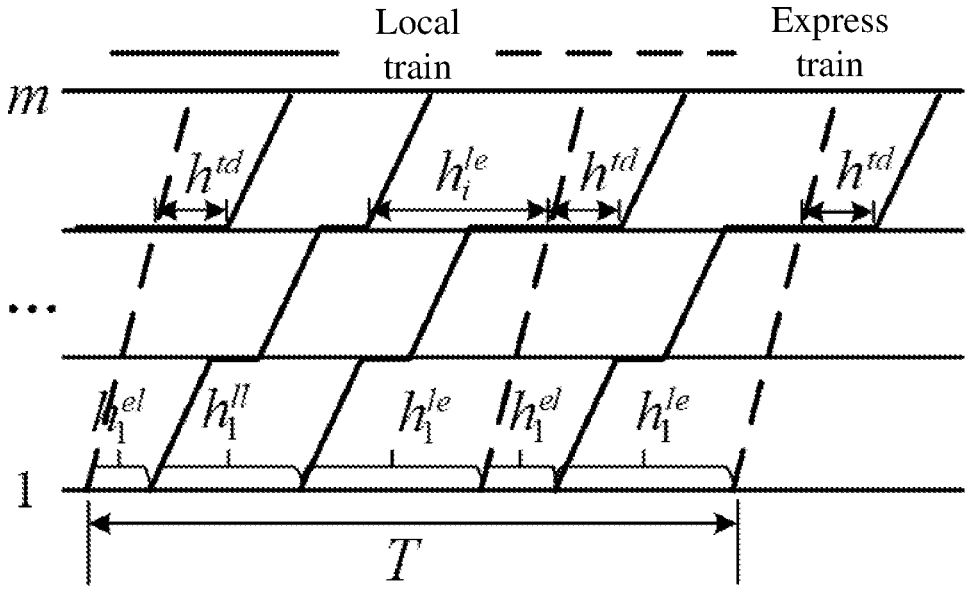
FIG. 2C illustrates a schematic diagram under mixed operation of express/local trains according to an embodiment of the disclosure, in which an express train number is 2, and p>q.
Figure 2D:
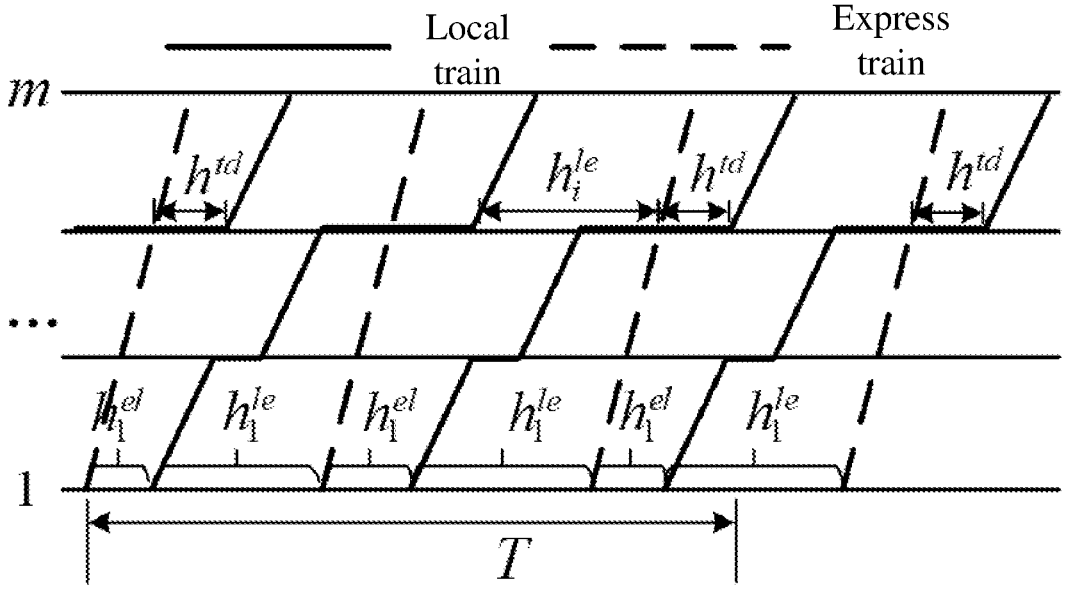
FIG. 2D illustrates a schematic diagram under mixed operation of express/local trains according to an embodiment of the disclosure, in which an express train number is 3, and p=q.
Figure 2E:
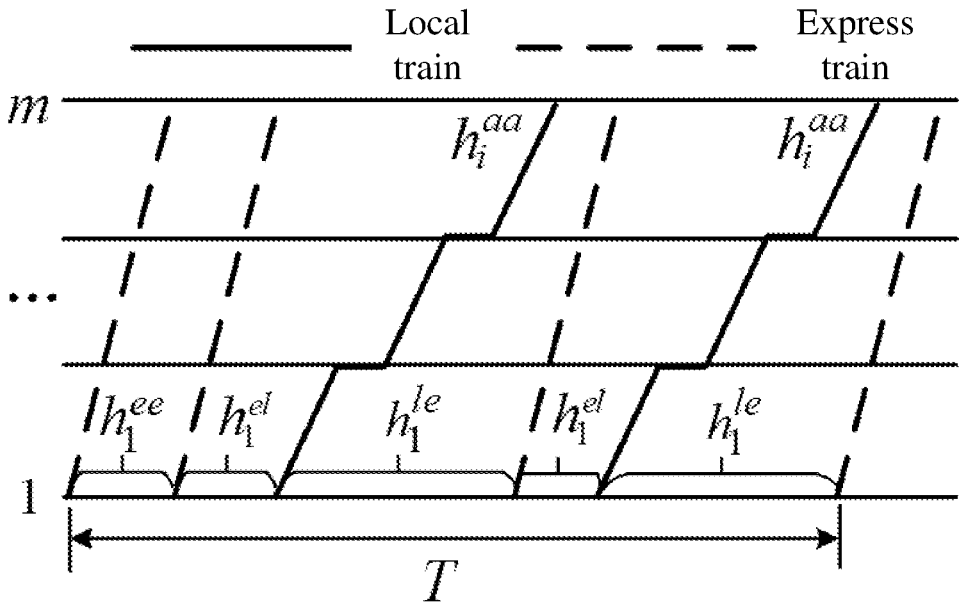
FIG. 2E illustrates a schematic diagram under mixed operation of express/local trains according to an embodiment of the disclosure, in which an express train number is 4, and p<q.
Figure 2F:
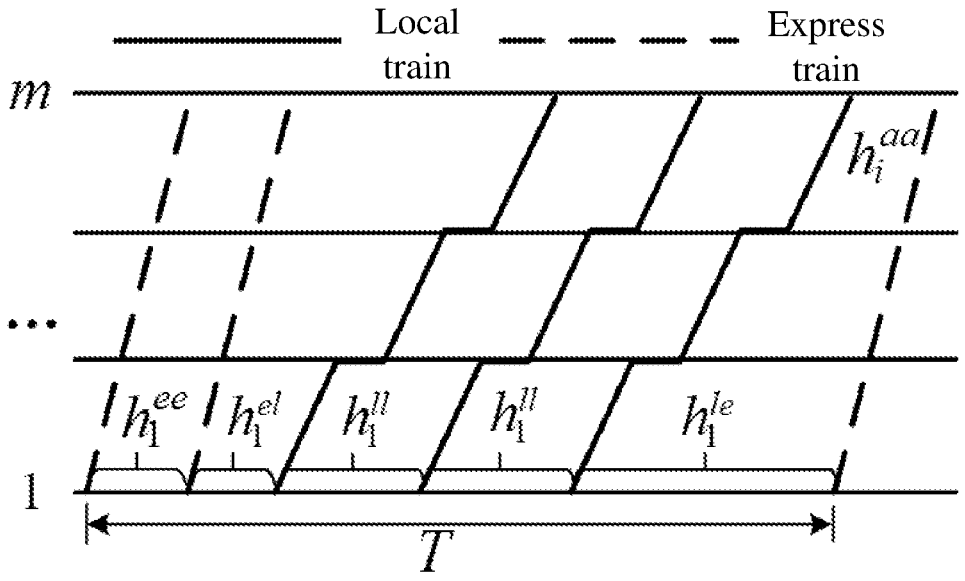
FIG. 2F illustrates a schematic diagram under mixed operation of express/local trains according to an embodiment of the disclosure, in which express trains are operated in an express train continuous departure scheme, and p>q.

In a situation that the express train number q is not greater than the local train number p, after express trains are inserted in a train operation diagram during interval under interval time between express/local train alternative operation, as shown in FIG. 2B, FIG. 2C, and FIG. 2D, the express/local train mixed operation cycle time is divided into three parts: express/local train departure interval time $h^{el}$, local-local train departure interval time $h^{ll}$, and local-express train departure interval time $h^{le}$, as shown in FIG. 2B. The express/local train departure interval time $h^{el}$ and the local-express train departure interval time $h^{le}$ are generated owing to inserting of the express trains, therefore, when the express train number q is increased by 1 unit, the express/local train departure interval time $h^{el}$ and the local-express train departure interval time $h^{le}$ are each increased by 1 unit. The number of the local-local train departure interval time $h^{ll}$ is related to the express train number q and the local train number p. From FIG. 2A, the number of the local-local train departure interval time $h^{ll}$ in one express/local train mixed operation cycle time is (p−1), due to the inserting of the express trains, $h^{ll}$ is decomposed into $h^{el}$ and $h^{le}$. That is to say, when the express train number q is increased by 1 unit, the number of the local-local train departure interval time $h^{ll}$ is reduced by 1 unit. As shown in FIG. 2F, when express trains are inserted in the train operation diagram under an express train continuous departure scheme, an express-express train departure interval time $h^{ee}$ is added, and the number of the express-express train departure interval time $h^{ee}$ in one express/local train mixed operation cycle time is (q−1). In summary, in a situation of p≥q, the express/local train mixed operation cycle time, the local train number p and the express train number q are obtained through a formula (2) expressed as follows:

$$T = \begin{cases} q\left(h^{el} + h^{le}\right) + (p-q)h^{ll} & \text{Under express/local train alternative operation scheme} \\ (q-1)h^{ee} + (p-q)h^{ll} + h^{el} + h^{le} & \text{Under express train continuous departure scheme} \end{cases} \tag{2}$$

In a situation of p<q and the express trains are operated under the express train continuous departure scheme, the express/local train mixed operation cycle time is divided into three parts: express/local train departure interval time $h^{el}$, express-express train departure interval time $h^{ee}$, and a local-express train departure interval time $h^{le}$. The quantitative relationship between these three types of interval time and an express/local train number can be deduced similar to the above. Therefore, in a situation of p<q, the express/local train mixed operation cycle time, the local train number p and the express train number q are obtained through a formula (3) expressed as follows:

$$T = \begin{cases} p\left(h^{el} + h^{le}\right) + (q-p)h^{ee} & \text{Under express/local train alternative operation scheme} \\ (q-1)h^{ee} + (p-1)h^{ll} + h^{el} + h^{le} & \text{Under express train continuous departure scheme} \end{cases}. \tag{3}$$

Figure 3:
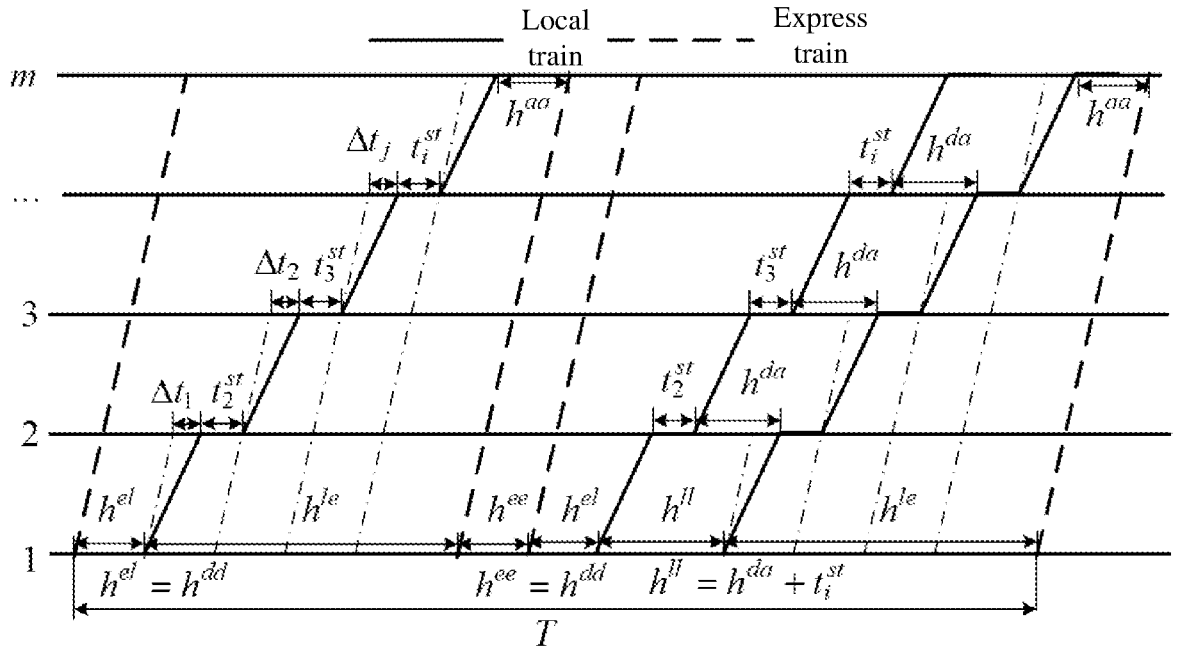
FIG. 3 illustrates a schematic diagram of cycle time calculation in an express/local train following operation mode according to an embodiment of the disclosure.

Further, in the calculation of cycle time under the express/local train following operation mode, the express/local train following operation mode is to make some trains pass through some selected stations without stopping at the some selected stations to achieve a set time target value by adjusting departure interval time. As shown in FIG. 3, as the operation process of express/local trains advances, the operation interval between adjacent express/local trains will gradually decrease, and when the operation interval does not meet a minimum following interval requirement, a preceding train has reached the terminal station. Therefore, under the express/local train following operation mode, the calculation of cycle time mainly depends on departure interval time between two adjacent trains at the starting station and arrival interval time between two adjacent trains at the terminal station.

According to a structure of a parallel operation diagram and a compact running principle, it can be seen that when a preceding train is a non-stop express train, which does not stop at an intermediate station, the departure-arrival interval does not need to consider the constraint of the arrival-departure interval time of the following station trains. Therefore, the departure interval time $h^{el}$ and $h^{ee}$ are uniformly represented by minimum departure interval time $h^{dd}$ that can be satisfied by a signal system. For the local-local departure interval time $h^{ll}$, it can be expressed by stop interval time $t_2^{st}$ and the departure-arrival interval time $h^{da}$ of the local train at a subsequent station. For the local-express departure interval time $h^{le}$, it is mainly affected by a section operation time difference $\Delta t_j$ of express/local train, local train stop interval time $t_i^{st}$, and arrival interval time $h^{aa}$ for the terminal station. Combined with formulas (2) and (3) of the quantitative relationship between operation cycle time and interval time of express and local trains, formulas (4) and (5) for calculating the express/local train mixed operation cycle time in the following operation mode are given:

$$T_a = \begin{cases} q\left(h^{aa} + h^{dd}\right) + (p-q)h^{da} + q\left(\sum_{i=2}^{m-1} t_i^{st} + \sum_{j=1}^{m-1} \Delta t_j\right) + (p-q)t_{m-1}^{st} & \text{when } 1 \le q \le p; \\ ph^{aa} + qh^{dd} + p\left(\sum_{i=2}^{m-1} t_i^{st} + \sum_{j=1}^{m-1} \Delta t_j\right) & \text{when } 1 \le p < q \end{cases} \tag{4}$$

$$T_b = qh^{dd} + (p-1)h^{da} + h^{aa} + \sum_{i=2}^{m-1} t_i^{st} + \sum_{j=1}^{m-1} \Delta t_j + (p-1)t_{m-1}^{st}. \tag{5}$$

Formulas (4) and (5) respectively represent the calculation method of the operation cycle time of the express/local train alternative operation scheme and the express train continuous departure scheme in the following operation mode.

Under the condition of mixed operation of express/local trains, the most direct influence on line carrying capacity is the overtaking relationship. Therefore, the setting of the overtaking station and its determined overtaking relationship are the core elements of line carrying capacity calculation.

Figure 4:
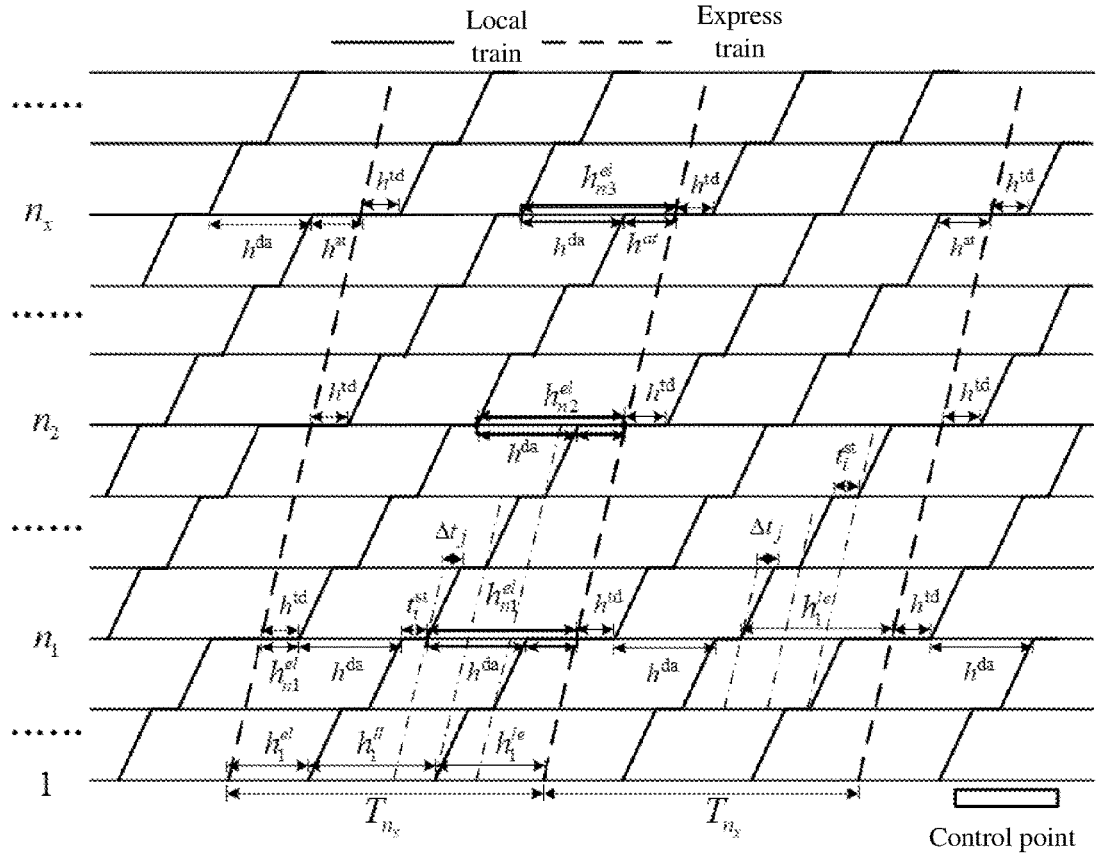
FIG. 4 illustrates a schematic diagram of cycle time calculation in an express/local train overtaking operation mode according to an embodiment of the disclosure.

As can be seen from FIG. 4, when the express train catches up with the local train and performs an overtaking action, a following interval of the overtaking station changes from local before and then express to express before and then local. At this time, the calculation of the carrying capacity of the overtaking station $n_x$ depends on following interval time $h_{n_x}^{le}$ between a preceding local train and an overtaking express train. According to the structure of the train operation diagram in FIG. 4, the calculation of $h_{n_x}^{le}$ is related to express/local train departure interval time $h_1^{le}$ at the starting station, and $h_1^{le}$ has a certain quantitative relationship with $h_{n_x}^{le}$, the local train stop interval time $t_i^{st}$, and the section operation time difference $\Delta t_j$ of express/local train.

Therefore, for the case where the overtaking station acts as a control point of capacity calculation, according to the compact running principle, the express/local train departure interval time $h_{n_x}^{le}$ is mainly constrained, and the express/local train departure interval time $h_1^{le}$ for the starting station is changed, so a derivation process is performed from the express/local train departure interval time $h_1^{le}$ for the starting station.

(1) A first overtaking station is taken as a capacity calculation control point, it is determined that $h_{n_1}^{le}=h^{at}+h^{da}$ based on the compact running principle, and it can be derived that the express/local train departure interval time $h_1^{le}$ for the starting station and express/local train departure interval time $h_{n_1}^{le}$ for the first overtaking station can be obtained through a formula (6) expressed as follows:

$$h_{n_1}^{le} = h_1^{le} - \sum_{i=2}^{n_1-1} t_i^{st} - \sum_{j=1}^{n_1-1} \Delta t_j + h^{da}; \tag{6}$$

$h_{n_1}^{le}=h^{at}+h^{da}$ is substituted into the formula (6) to thereby obtain a formula (7) expressed as follows:

$$h_1^{le} = h^{at} + \sum_{i=2}^{n_1-1} t_i^{st} + \sum_{j=1}^{n_1-1} \Delta t_j; \tag{7}$$

express/local train mixed operation cycle time under taking the first overtaking station as the capacity calculation control point is obtained through a formula 8 expressed as follows:

$$T_{n_1} = qh^{dd} + (p-q)(t_{n_1}^{st} + h^{da}) + q\left(h^{at} + \sum_{i=2}^{n_1-1} t_i^{st} + \sum_{j=1}^{n_1-1} \Delta t_j\right). \tag{8}$$

(2) In a situation that the overtaking station number is increased to 2, the express/local train departure interval time $h_{n_1}^{le}$ for the first overtaking station is affected, $h_{n_1}^{le}$ no longer only depends on $h^{at}$ and $h^{da}$, but also depends on express/local train departure interval time $h_{n_2}^{le}$ for a second overtaking station. It is determined that $h_{n_2}^{le}=h^{at}+h^{da}$ based on the compact running principle, and a formula (9) is obtained, which is expressed as follows:

$$h_{n_2}^{le} = h_{n_1}^{le} - \sum_{i=n_1+1}^{n_2-1} t_i^{st} - \sum_{j=n_1}^{n_2-1} \Delta t_j + h^{da}; \tag{9}$$

$h_{n_2}^{le}=h^{at}+h^{da}$ is substituted into the formula (9) to thereby obtain a formula (10) expressed as follows:

$$h_{n_1}^{le} = h^{at} + \sum_{i=n_1+1}^{n_2-1} t_i^{st} + \sum_{j=n_1}^{n_2-1} \Delta t_j; \tag{10}$$

an iterating process is performed on $h_{n_1}^{le}$ and express/local train mixed operation cycle time under taking the second overtaking station as the capacity calculation control point is obtained through a formula (11) expressed as follows:

$$T_{n_2} = qh_1^{le} + (p-q)(t_{n_2}^{st} + h^{da}) + + q\left(h^{at} + \sum_{i=2}^{n_1-1} t_i^{st} + \sum_{j=1}^{n_1-1} \Delta t_j + \sum_{i=n_1+1}^{n_2-1} t_i^{st} + \sum_{j=n_1}^{n_2-1} \Delta t_j - h^{da}\right). \tag{11}$$

(3) In a situation that the overtaking station number is increased to x, express/local train departure interval time $h_{n_1}^{le}$, $h_{n_2}^{le}$, . . . , $h_{n_{x-1}}^{le}$ are affected;

mathematical induction is performed based on the derivation process to determine $h_{n_x}^{le}=h^{at}+h^{da}$, and obtaining a relationship between $h_{n_x}^{le}$ and $h_{n_{x-1}}^{le}$ through a formula (12) expressed as follows:

$$h_{n_x}^{le} = h_{n_{x-1}}^{le} - \sum_{i=n_{x-1}+1}^{n_x-1} t_i^{st} - \sum_{j=n_{x-1}}^{n_x-1} \Delta t_j + h^{da}; \tag{12}$$

an iterating process is performed repeatedly from $h_{n_{x-1}}^{le}$ to $h_1^{le}$ to thereby obtain express/local train mixed operation cycle time under taking an x-th overtaking station as the capacity calculation control point through a formula (13) expressed as follows:

$$T_{n_x} = qh_1^{le} + (p-q)(t_{n_x}^{st} + h^{da}) + + q\left[h^{at} + \sum_{i=2}^{n_1-1} t_i^{st} + \sum_{j=1}^{n_1-1} \Delta t_j + \ldots + \sum_{i=n_{x-1}+1}^{n_x-1} t_i^{st} + \sum_{j=n_{x-1}}^{n_x-1} \Delta t_j - (x-1)h^{da}\right]; \tag{13}$$

a minimum control point cycle function $f_x(W, n_x)$ is determined, which is expressed in a formula (14):

$$f_X(W, n_x) = h^{at} + \sum_{i=2}^{n_x} t_i^{st} + \sum_{j=1}^{n_x-1} \Delta t_j - \sum_{n_x \in W} t_{n_x}^{st} - (x-1)h^{da}; \tag{14}$$

The above formula (13) provides a calculation of express/local train mixed operation cycle time under taking an x-th overtaking station as the capacity calculation control point. Further, inn a situation that multiple overtaking stations are set on the line, comparing carrying capacities of the multiple overtaking stations to determine a control point affecting the line carrying capacity; calculating the express/local train mixed operation cycle time $T_c$ under the express/local train mixed operation mode according to a formula (15) expressed as follows:

$$T_c=\max\{T_{n_x}\}=\max\{qh^{dd}+(p-q)(t_{n_x}^{st}+h^{da})+qf_x(W,n_x)\} \quad (15).$$

When an express train stops at an intermediate station, the express/local train mixed operation cycle time is affected, the express train stop position divided into four categories: stopping at the second station or an (m−1)-th station; stopping at the front or back station of an overtaking station; stopping at an overtaking station; and stopping at other intermediate station.

In an embodiment, for the express train stop position, a cycle time calculation correction term g(i) considering the express train stop position is introduced.

(1) Stopping at the second station or the (m−1)-th station

Figure 5:
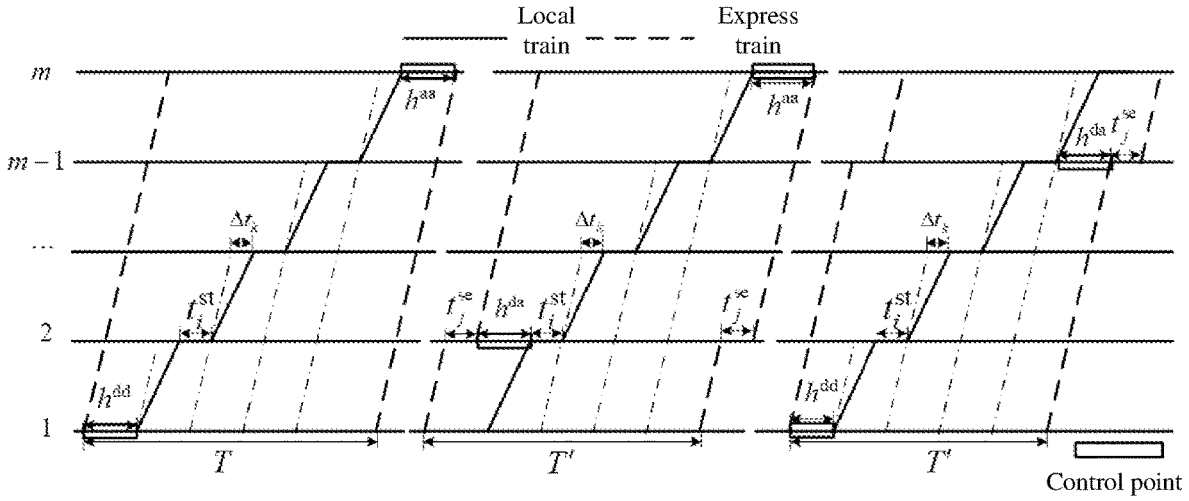
FIG. 5 illustrates a schematic diagram showing that an express train stops at a second station or an (m−1)-th station according to an embodiment of the disclosure.

As shown in FIG. 5, in a situation that a category of the express train stop position is stopping at the second station or the (m−1)-th station, express/local train mixed operation cycle time T' is derived according to express/local train mixed operation cycle time T under a situation of express train not stopping at the intermediate station. From FIG. 5, under a situation of express train not stopping at the intermediate station, the capacity calculation control point depends on an express/local train departure interval time $h^{aa}$ at a starting station and an express/local train departure interval time $h^{dd}$ at a terminal station, and the express/local train mixed operation cycle time T under a situation of express train not stopping at the intermediate station is $$T = h^{dd} + h^{aa} + \sum_{i=2}^{m-1} t_i^{st} + \sum_{j=1}^{m-1} \Delta t_j.$$

In a situation that a category of the express train stop position is stopping at the second station, the express/local train departure interval time $h^{dd}$ at the starting station is changed to an express/local train departure-arrival interval time $h^{da}$ at the second station, the express/local train mixed operation cycle time T' is $$T' = h^{da} + \sum_{i=2}^{m-1} t_i^{st} + \sum_{j=2}^{m-1} \Delta t_j + h^{aa},$$

and $g(2)=T'-T=h^{da}-h^{dd}-\Delta t_1$.

Figure 6:
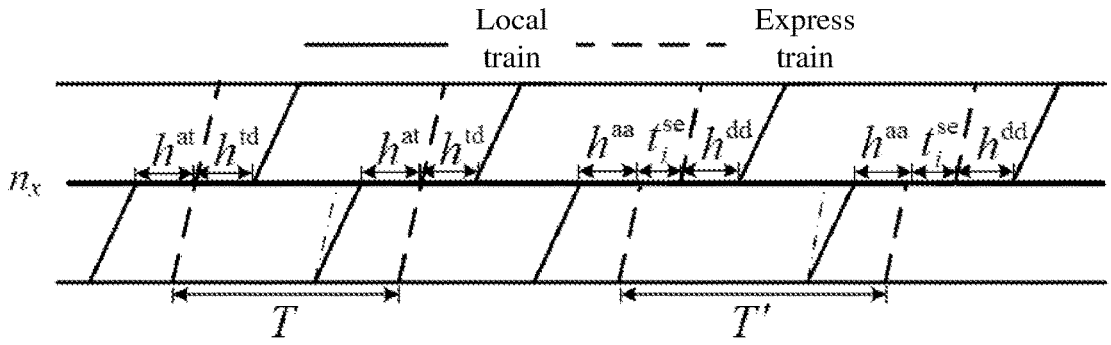
FIG. 6 illustrates a schematic diagram showing that an express train stops at an overtaking station, i.e., an $n_x$-th station according to an embodiment of the disclosure.

In a situation that a category of the express train stop position is stopping at the (m−1)-th station, the express/local train arrival interval time $h^{aa}$ at the terminal station is changed to an express/local train departure-arrival interval time $h^{da}$ at the (m−1)-th station, the express/local train mixed operation cycle time T' is $$T' = h^{da} + \sum_{i=2}^{m-1} t_i^{st} + \sum_{j=1}^{m-2} \Delta t_j + h^{dd},$$

and $g(m-1)=T'-T=h^{da}-h^{aa}-\Delta t_{m-2}$ (2) Stopping at an overtaking station $n_x$ As shown in FIG. 6, in a situation that a category of the express train stop position is stopping at an overtaking station, express/local train mixed operation cycle time T' is determined by subtracting express/local train arrival-through interval time $h^{at}$ at the $n_x$-th station and express/local train through-departure interval time $h^{td}$ at the $n_x$-th station from the express/local train mixed operation cycle time T under a situation of express train not stopping at the intermediate station and adding the express/local train departure interval time $h^{dd}$ at the $n_x$-th station, express/local train arrival interval time $h^{aa}$ at the $n_x$-th station, and express train stop interval time $t_{n_x}^{se}$ at the $n_x$-th station, thereby obtaining $T'=T-(h^{at}+h^{td})+(h^{aa}+h^{dd}+t_{n_x}^{se})$ and $g(n_x)=T'-T=(h^{aa}+h^{dd}+t_{n_x}^{se})-(h^{at}+h^{td})$.

(3) Stopping at an $(n_x-1)$-th station or an $(n_x+1)$-th station

Figure 7:
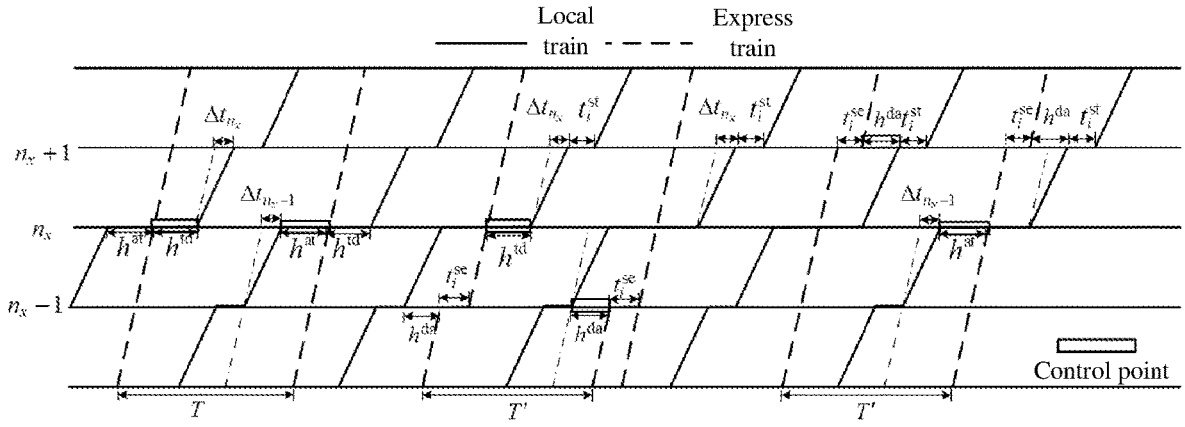
FIG. 7 illustrates a schematic diagram showing that an express train stops at an $(n_x-1)$-th station or an $(n_x+1)$-th according to an embodiment of the disclosure.

As shown in FIG. 7, in a situation that a category of the express train stop position is stopping at the $(n_x-1)$-th station, express/local train mixed operation cycle time T' is determined according to express/local train mixed operation cycle time T by subtracting express/local train arrival-through interval time $h^{at}$ at an $n_x$-th station and an express/local train operation time difference $\Delta t_{n_x-1}$ at an $(n_x-1)$-th section from express/local train mixed operation cycle time T under a situation of express train not stopping at the intermediate station and adding express/local train departure-arrival interval time $h^{da}$ at the $(n_x-1)$-th station, thereby obtaining $$T'=T-h^{at}-\Delta t_{n_x-1}+h^{da}+t_{n_x-1}^{se} \text{ and } g(n_x-1)=T'-T=h^{da}-h^{at}+t_{n_x-1}-\Delta t_{n_x-1}.$$

In a situation that a category of the express train stop position is stopping at an $(n_x+1)$-th station, express/local train mixed operation cycle time T' is determined by subtracting express/local train through-departure interval time $h^{td}$ at the $n_x$-th station and an express/local train operation time difference $\Delta t_{n_x}$ at an $n_x$-th section from express/local train mixed operation cycle time T under a situation of express train not stopping at the intermediate station and adding express/local train departure-arrival interval time $h^{da}$ at the $(n_x+1)$-th station, thereby obtaining $T'=T-h^{td}-\Delta t_{n_x}+h^{da}+t_{n_{x+1}}^{se}+_1$ and $g(n_x+1)=T'-T=h^{da}-h^{td}+t_{n_{x+1}}^{se}+\Delta t_{n_x}$.

(4) Stopping at other intermediate station

Figure 8:
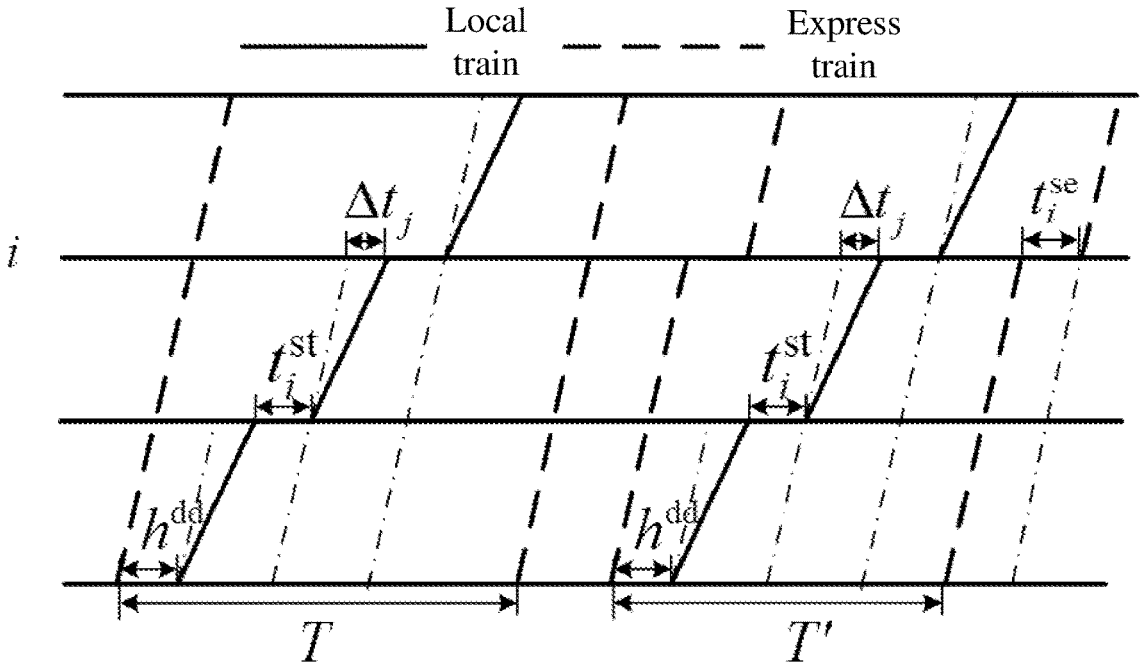
FIG. 8 illustrates a schematic diagram showing that an express train stops at other station according to an embodiment of the disclosure.

As shown in FIG. 8, in a situation that a category of the express train stop position is stopping at other intermediate station, express/local train mixed operation cycle time T' is determined by subtracting total express train stop interval time $\Sigma t_i^{se}$ from express/local train mixed operation cycle time T under a situation of express train not stopping at the intermediate station, thereby obtaining $T'=T-\Sigma t_i^{se}$ and $g(i)=-\Sigma t_i^{se}$.

Based on the above, the cycle time calculation correction term g(i) considering the express train stop position is calculated according to a formula (16), which is expressed as follows:

$$g(i) = \begin{cases} h^{da} - h^{dd} - \Delta t_1,\ i = 2 \\ h^{da} - h^{aa} - \Delta t_{m-2},\ i = m-1 \\ \left(h^{aa} + h^{dd} + t_{n_1}^{se}\right) - \left(h^{at} + h^{td}\right),\ i = n_x \\ h^{da} - h^{at} + t_{n_1-1}^{se} - \Delta t_{n_1-1},\ i = n_x - 1 \\ h^{da} - h^{td} + t_{n_1+1}^{se} - \Delta t_{n_1},\ i = n_x + 1 \\ -\sum t_i^{se},\ i \text{ for other values} \end{cases} \quad (16)$$

Figure 9:
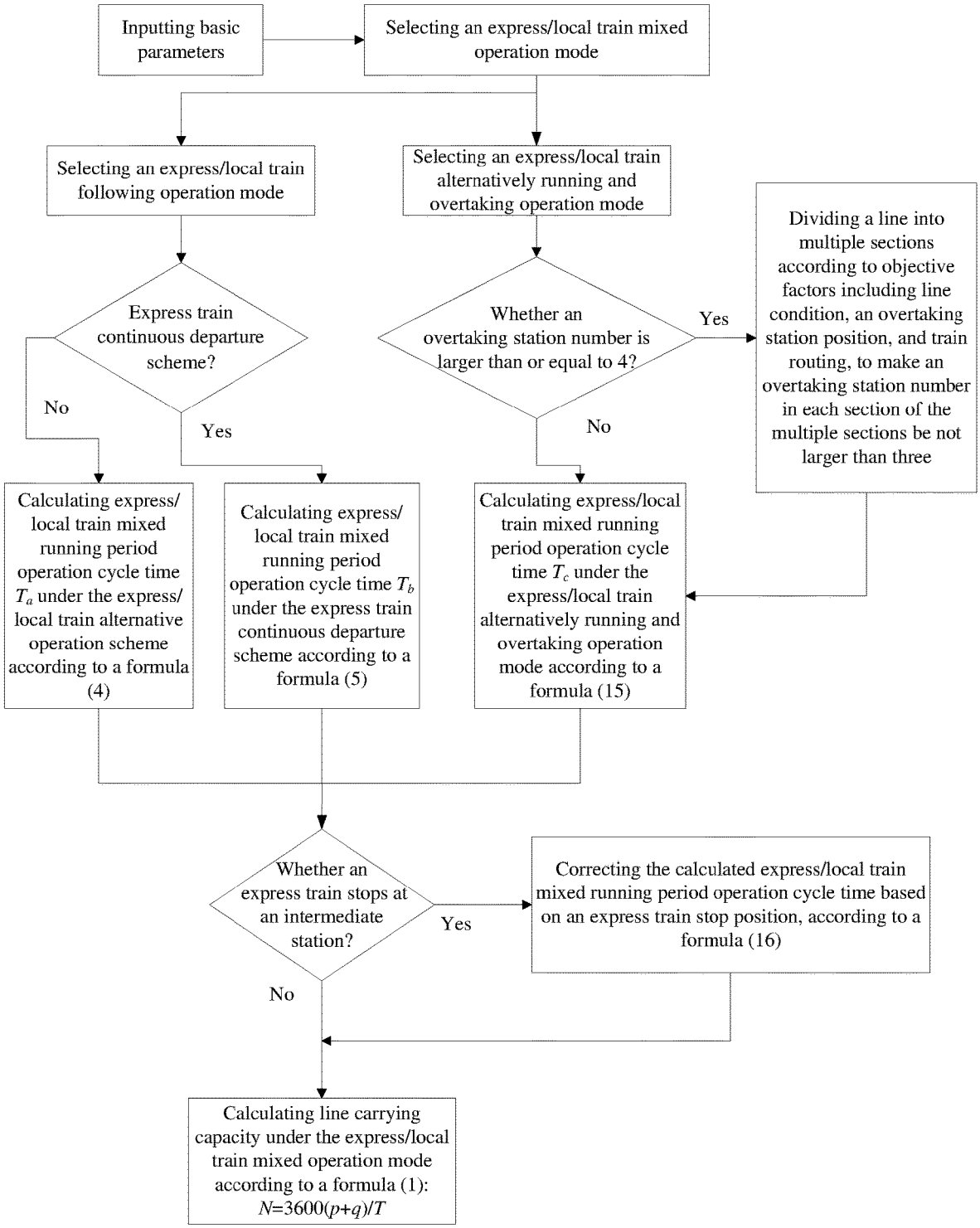
FIG. 9 illustrates a flow chart of a calculation method of line carrying capacity of regional rapid rail transit under mixed operation of express/local trains according to an embodiment of the disclosure.

Therefore, the calculation process of line carrying capacity of regional rapid rail transit under mixed operation of express/local trains will be carried out from several aspects, such as the express/local train mixed operation mode, whether the express train stops or not at the intermediate station, and the overtaking station number. The calculation method of line carrying capacity of regional rapid rail transit under mixed operation of express/local trains of disclosure can be obtained through the flowchart shown in FIG. 9, which may include:

step 1, inputting basic parameters, the basic parameters include:

line parameters, including: a station number m of stations; a station serial number i of each station, which satisfies $\{i|1\leq i\leq m, i\in N^+\}$; a section serial number j of each section, which satisfies $\{j|1\leq j\leq m-1, j\in N^+\}$; an overtaking station serial number $n_x$; an overtaking station serial number set W, which satisfies $n_x\in W$; and an overtaking station number x, which is a total number of an overtaking station in the overtaking station serial number set W;

operation scheme parameters, including: an express train number q, a local train number p, and a ratio q:p of express/local trains; and time parameters, including: minimum arrival-through interval time $h^{at}$; minimum through-departure interval time $h^{td}$; minimum departure-arrival interval time $h^{da}$; minimum arrival interval time $h^{aa}$; minimum departure interval time $h^{dd}$; an express/local train operation time difference $\Delta t_j$ at j-th section; local train stop interval time $t_i^{st}$ at a station i; and an express train stop interval time $t_i^{se}$ at the station i;

step 2, selecting an express/local train mixed operation mode as an express/local train following operation mode or an express/local train alternatively running and overtaking operation mode; and in response to the selection of the express/local train following operation mode, performing step 3, or in response to the selection of the express/local train alternatively running and overtaking operation mode, performing step 4;

step 3, determining whether an express/local train operation scheme under the express/local train following operation mode is an express/local train alternative operation scheme or an express train continuous departure scheme; and in response to the express/local train operation scheme being the express/local train alternative operation scheme, performing step 3.1, or in response to the express/local train operation scheme being the express train continuous departure scheme, performing step 3.2;

step 3.1, calculating express/local train mixed operation cycle time $T_a$ according to a formula (4) expressed as follows, and performing step 5, $$T_a=\begin{cases} q\left(h^{aa}+h^{dd}\right)+(p-q)h^{da}+q\left(\sum_{i=2}^{m-1}t_i^{st}+\sum_{j=1}^{m-1}\Delta t_j\right)+ \\ \qquad (p-q)t_{m-1}^{st} \quad \text{when } 1\leq q\leq p \\ ph^{aa}+qh^{dd}+p\left(\sum_{i=2}^{m-1}t_i^{st}+\sum_{j=1}^{m-1}\Delta t_j\right) \quad \text{when } 1\leq p<q \end{cases}; \tag{4}$$

step 3.2, calculating express/local train mixed operation cycle time $T_b$ according to a formula (5) expressed as follows, and performing step 5, $$T_b=qh^{dd}+(p-1)h^{da}+h^{aa}+\sum_{i=2}^{m-1}t_i^{st}+\sum_{j=1}^{m-1}\Delta t_j+(p-1)t_{m-1}^{st}; \tag{5}$$

step 4, determining the overtaking station number x according to the overtaking station serial number set W under the express/local train alternatively running and overtaking operation mode; and in response to the overtaking station number x being less than 4, performing step 4.1; or in response to the overtaking station number x being not less than 4, performing step 4.2;

step 4.1, calculating express/local train mixed operation cycle time $T_c$ according to a formula (15) expressed as follows, and performing step 5, $$T_c=\max\{T_{n_x}\}=\max\{qh^{dd}+(p-q)(t_{n_x}^{st}+h^{da})+qf_x(W,n_x)\} \tag{15};$$

step 4.2, dividing a line into multiple sections according to objective factors including line condition, overtaking station position, and train routing, to make an overtaking station number in each section of the multiple sections be not larger than three, dividing of the multiple sections follows principles of less division times and relatively balanced division; and performing step 4.1;

step 5, determining whether an express train stops or not at an intermediate station according to the line parameters; in response to the express train only stopping at starting and terminal stations, taking the express/local train mixed operation cycle time as a final express/local train mixed operation cycle time, performing step 7; or in response to the express train stopping at the intermediate station, performing step 6;

step 6, correcting the calculated express/local train mixed operation cycle time, based on the calculated express/local train mixed operation cycle time and an express train stop position, according to formula (16) expressed as follows, to obtain a corrected express/local train mixed operation cycle time as a final express/local train mixed operation cycle time; and performing step 7, $$g(i)=\begin{cases} h^{da}-h^{dd}-\Delta t_1,\ i=2 \\ h^{da}-h^{aa}-\Delta t_{m-2},\ i=m-1 \\ \left(h^{aa}+h^{dd}+t_{n_1}^{se}\right)-\left(h^{at}+h^{td}\right),\ i=n_x \\ h^{da}-h^{at}+t_{n_1-1}^{se}-\Delta t_{n_1-1},\ i=n_x-1 \\ h^{da}-h^{td}+t_{n_1+1}^{se}-\Delta t_{n_1},\ i=n_x+1 \\ -\sum t_i^{se},\ i \text{ for other values} \end{cases}; \tag{16}$$

step 7, calculating, based on the final express/local train mixed operation cycle time, the line carrying capacity under the express/local train mixed operation mode according to a formula (1):

$$N=3600(p+q)/T \tag{1}.$$

The disclosure will now be further described with a specific example.

Based on the data of a domestic city express rail line, a maximum line carrying capacity under different operation schemes is analyzed by using the calculation method of line carrying capacity of regional rapid rail transit under mixed operation of express/local trains of the disclosure, and the effectiveness of the disclosure is verified.

Step 1, basic parameters are inputted.

There are 8 stations (m=8) on this line, and a B-type train with 6 carriages is adopted. Specifically, there are two overtaking stations (x=2), which are respectively set at the second and sixth stations of the line, that is, $n_1=2$, $n_2=6$, and an overtaking station serial number set satisfies $W=\{n_1, n_2\}$. A ratio q:p of express/local trains is q:p=2:4.

According to design documents of the line and design capability of a signal system, the values of $h^{at}$, $h^{td}$, $h^{da}$, $h^{aa}$ and $h^{dd}$ are determined respectively. For simplicity of calculation, the express/local train departure interval time $h^{dd}$ at a starting station is 90 s, express/local train arrival interval time $h^{aa}$ at a terminal station is 120 s; express/local train departure-arrival interval time $h^{da}$ of each station is 90 s;

arrival-through interval time $h^{at}$ of each overtaking station is 90 s; through-departure interval time $h^{td}$ of the overtaking station is 60 s; local train stop interval time $t_i^{st}$ and express train stop interval time $t_i^{se}$ are each 30 s; and an express/local train operation time difference $\Delta t_j$ at each section (saving time of the express train at each section compared with the local train) is uniformly set to 20 s.

Step 2, according to the train operation organization and line conditions, it is known that the express/local train mixed operation mode adopts the overtaking operation mode and step 3 is performed.

Step 3, according to the overtaking station serial number set W, it can be known that there are two overtaking stations on the line, which are set at the second and sixth stations of the line respectively, and then step 4 is performed.

Step 4, express/local train mixed operation cycle time is calculation according to the overtaking station number by using the formula (15). Therefore, express/local train mixed operation cycle time $T_c$ is:

$$T_c = \max\{T_{n_x}\} = \max\{qh^{dd} + (p-q)(t_{n_x}^{st} + h^{da}) + qf_x(W, n_x)\} = \max\{qh^{dd} + (p-q)(t_{n_x}^{st} + h^{da}) + q\left(h^{at} + \sum_{i=2}^{n_x} t_i^{st} + \sum_{j=1}^{n_x-1} \Delta t_j - \sum_{n_x \in W} t_{n_x}^{st} - (x-1)h^{da}\right)\}$$

By substituting the relevant parameters in the step 1, it can be obtained that express/local train mixed operation cycle time under taking the first overtaking station as the capacity calculation control point and express/local train mixed operation cycle time under taking the second overtaking station as the capacity calculation control point are as follows:

$$T_{n_1} = qh^{dd} + (p-q)(t_{n_1}^{st} + h^{da}) + q\left(h^{at} + \sum_{i=2}^{n_1} t_i^{st} + \sum_{j=1}^{n_1-1} \Delta t_j - \sum_{n_x \in W} t_{n_x}^{st} - (1-1)h^{da}\right) = 2\times 90 + (4-2)\times(30+90) + 2\times\left(90 + \sum_{i=2}^{2} t_i^{st} + \sum_{j=1}^{1} \Delta t_j - t_2^{st}\right) = 640 \text{ s}$$

$$T_{n_2} = qh^{dd} + (p-q)(t_{n_2}^{st} + h^{da}) + q\left(h^{at} + \sum_{i=2}^{n_2} t_i^{st} + \sum_{j=1}^{n_2-1} \Delta t_j - \sum_{n_x \in W} t_{n_x}^{st} - (2-1)h^{da}\right) = 2\times 90 + (4-2)\times(30+90) + 2\times\left(90 + \sum_{i=2}^{6} t_i^{st} + \sum_{j=1}^{5} \Delta t_j - t_2^{st} - t_6^{st}\right) = 1220 \text{ s.}$$

Therefore, the calculation result of the express/local train mixed operation cycle time in the overtaking operation mode are as follows:

$$T_c = \max\{T_{n_x}\} = \max\{T_{n_1}, T_{n_2}\} = \max\{640\ s, 1220\ s\} = 1220\ s.$$

Step 5, according to the stop plan of the express train, it can be known that the express train only stops at the starting and terminal stations of the line, and does not stop at the intermediate station, so there is no need to modify the calculation result of the express/local train mixed operation cycle time, and it is only necessary to directly substitute it into formula (1) to calculate the line carrying capacity.

Therefore, the calculation result of the line carrying capacity of regional rapid rail transit under mixed operation of express/local trains in the overtaking operation mode are as follows:

$$N = \frac{3600(p+q)}{T_c} = \frac{3600\times(2+4)}{1220} \approx 17 \text{ per hour}$$

Thus, the disclosure has the advantages as follows.

(1) The disclosure constructs a calculation method of line carrying capacity of regional rapid rail transit under mixed operation of express/local trains, which can adapt to certain line conditions and operation modes. Considering the influence factors such as the overtaking station number, an interval distance between overtaking stations and the interval time between trains, the disclosure puts forward the calculation method of line carrying capacity of regional rapid rail transit under mixed operation of express/local trains under the two operation and organization modes of an express/local train following operation mode or an express/local train alternatively running and overtaking operation mode, and derives the corresponding calculation formulas. The disclosure provides calculation method of line carrying capacity of regional rapid rail transit under mixed operation of express/local trains, and also provides a theoretical basis for line planning and design.

(2) Based on the analysis of the structure of the train operation diagram, a quantitative relationship between operation cycle time and interval time under mixed operation of express/local trains under different running ratios of express and local trains is constructed, which provides a theoretical basis for quantifying the calculation process of the express/local train mixed operation cycle time.

(3) In view of the express/local train mixed operation mode in the overtaking operation mode, the difference of the overtaking conditions of express trains and the number and location of overtaking stations will lead to the increase of the local train stop interval time of and the increase of the express/local train departure interval time, thus losing part of the carrying capacity. The disclosure provides the overtaking station capacity calculation control function in the overtaking operation mode, which can effectively reflect the influence of the change of the number and position of overtaking stations on the carrying capacity calculation result.

(4) Aiming at the stop position, stop times and other situations of the express train, the disclosure puts forward a cycle time correction function for the express/local train mixed operation cycle time, which can directly reflect the influence on the cycle time after the change of the stop position, stop times and other influencing factors of the express train on the basis of the cycle time calculation result under a situation of express train not stopping at the intermediate station.

It is apparent that the above description and records are only examples and are not intended to limit the disclosure, application, or use of the present disclosure. Although embodiments have been described in DETAILED DESCRIPTION OF EMBODIMENTS and illustrated in the drawings, the disclosure is not limited to the specific examples illustrated in the drawings and described in the embodiments to implement the teachings of the disclosure, and the scope of the disclosure will include any embodiments that fall within the foregoing description and appended claims.

What is claimed is:

1. A calculation method of line carrying capacity of regional rapid rail transit under mixed operation of express/local trains, comprising:

step 1, inputting basic parameters, wherein the basic parameters comprise:

line parameters, comprising: a station number m of stations; a station serial number i of each station; an overtaking station serial number $n_x$; an overtaking station serial number set W, which satisfies $n_x \in W$; and an overtaking station number x, which is a total number of an overtaking station in the overtaking station serial number set W;

operation scheme parameters, comprising: an express train number q, a local train number p, a ratio q:p of express/local trains, and an express/local train mixed operation mode; and time parameters, comprising: minimum arrival-through interval time $h^{at}$; minimum through-departure interval time $h^{td}$; minimum departure-arrival interval time $h^{da}$; minimum arrival interval time $h^{aa}$; minimum departure interval time $h^{dd}$; an express/local train operation time difference $\Delta t_j$ at a j-th section; local train stop interval time $t_i^{st}$ at a station i; and express train stop interval time $t_i^{se}$ at the station i;

step 2, selecting the express/local train mixed operation mode as an express/local train following operation mode or an express/local train alternatively running and overtaking operation mode; and in response to the selection of the express/local train following operation mode, performing step 3, or in response to the selection of the express/local train alternatively running and overtaking operation mode, performing step 4;

step 3, determining whether an express/local train operation scheme under the express/local train following operation mode is an express/local train alternative operation scheme or an express train continuous departure scheme; and in response to the express/local train operation scheme being the express/local train alternative operation scheme, performing step 3.1, or in response to the express/local train operation scheme being the express train continuous departure scheme, performing step 3.2;

step 3.1, calculating express/local train mixed operation cycle time $T_a$ according to a formula (4) expressed as follows, and performing step 5, $$T_a = \begin{cases} q\left(h^{aa} + h^{dd}\right) + (p-q)h^{da} + q\left(\sum_{i=2}^{m-1} t_i^{st} + \sum_{j=1}^{m-1} \Delta t_j\right) + \\ \quad (p-q)t_{m-1}^{st} \quad \text{when } 1 \le q \le p \\ ph^{aa} + qh^{dd} + p\left(\sum_{i=2}^{m-1} t_i^{st} + \sum_{j=1}^{m-1} \Delta t_j\right) \quad \text{when } 1 \le p < q \end{cases}; \tag{4}$$

step 3.2, calculating express/local train mixed operation cycle time $T_b$ according to a formula (5) expressed as follows, and performing step 5, $$T_b = qh^{dd} + (p-1)h^{da} + h^{aa} + \sum_{i=2}^{m-1} t_i^{st} + \sum_{j=1}^{m-1} \Delta t_j + (p-1)t_{m-1}^{st}; \tag{5}$$

step 4, determining the overtaking station number x according to the overtaking station serial number set W under the express/local train alternatively running and overtaking operation mode; and in response to the overtaking station number x being less than 4, performing step 4.1; or in response to the overtaking station number x being not less than 4, performing step 4.2;

step 4.1, calculating express/local train mixed operation cycle time T, according to a formula (15) expressed as follows, and performing step 5, $$T_c = \max\{T_{n_x}\} = \max\{qh^{dd} + (p-q)(t_{n_x}^{st} + h^{da}) + qf_x(W, n_x)\} \tag{15};$$

step 4.2, dividing a line into multiple sections according to objective factors comprising line condition, an overtaking station position, and train routing, to make an overtaking station number in each section of the multiple sections be not larger than three, wherein dividing of the multiple sections follows principles of less division times and balanced division; and performing step 4.1;

step 5, determining whether an express train stops or not at an intermediate station according to the line parameters; in response to the express train only stopping at starting and terminal stations, taking the express/local train mixed operation cycle time as final express/local train mixed operation cycle time, performing step 7; or in response to the express train stopping at the intermediate station, performing step 6;

step 6, correcting the calculated express/local train mixed operation cycle time based on an express train stop position according to a formula (16) expressed as follows, to obtain corrected express/local train mixed operation cycle time as final express/local train mixed operation cycle time; and performing step 7, $$g(i) = \begin{cases} h^{da} - h^{dd} - \Delta t_1, \ i = 2 \\ h^{da} - h^{aa} - \Delta t_{m-2}, \ i = m-1 \\ \left(h^{aa} + h^{dd} + t_{n_1}^{se}\right) - \left(h^{at} + h^{td}\right), \ i = n_x \\ h^{da} - h^{at} + t_{n_1-1}^{se} - \Delta t_{n_1-1}, \ i = n_x - 1 \\ h^{da} - h^{td} + t_{n_1+1}^{se} - \Delta t_{n_1}, \ i = n_x + 1 \\ -\sum t_i^{se}, \ i \text{ for other values} \end{cases}; \tag{16}$$

and step 7, calculating, based on the final express/local train mixed operation cycle time, the line carrying capacity under the express/local train mixed operation mode according to a formula (1):

$$N = 3600(p+q)/T \tag{1};$$

wherein the calculation method further comprises: sending the line carrying capacity to a designer of the line, and designing, based on the line carrying capacity, a train operation manner for the line by the designer to thereby operate express and local trains in the line according to the train operation manner.

2. The calculation method of line carrying capacity of regional rapid rail transit under mixed operation of express/local trains as claimed in claim 1, wherein in the step 3, in a situation that the express train number q is not greater than the local train number p, when express trains are inserted in a train operation diagram during interval time between express/local train alternative operation, the express/local train mixed operation cycle time are divided into three parts: express/local train departure interval time $h^{el}$ local-local train departure interval time $h^{ll}$, and local-express train departure interval time $h^{le}$; wherein the express/local train departure interval time $h^{el}$ and the local-express train departure interval time $h^{le}$ are generated owing to inserting of the express trains; when the express train number q is increased by 1 unit, the express/local train departure interval time $h^{el}$ and the local-express train departure interval time $h^{le}$ are each increased by 1 unit; the number of the local-local train departure interval time $h^{ll}$ is related to the express train number q and the local train number p; the number of the local-local train departure interval time $h^{ll}$ in one express/local train mixed operation cycle time is (p−1), due to the inserting of the express trains, $h^{ll}$ is decomposed into $h^{el}$ and $h^{le}$; and when the express train number q is increased by 1 unit, the number of the local-local train departure interval time $h^{ll}$ is reduced by 1 unit;

in a situation that the express train number q is not greater than the local train number p, when express trains are inserted in a train operation diagram under the express train continuous departure scheme; an express-express train departure interval time $h^{ee}$ is added, wherein the number of the express-express train departure interval time $h^{ee}$ in one express/local train mixed operation cycle time is (q−1);

in a situation of p≥q, the express/local train mixed operation cycle time, the local train number p and the express train number q are obtained through a formula (2) expressed as follows:

$$T = \begin{cases} q(h^{el} + h^{le}) + (p-q)h^{ll} & \text{Under express/local train alternative operation scheme} \\ (q-1)h^{ee} + (p-1)h^{ll} + h^{el} + h^{le} & \text{Under express train continuous departure scheme} \end{cases}; \quad (2)$$

in a situation of p<q, the express/local train mixed operation cycle time, the local train number p and the express train number q are obtained through a formula (3) expressed as follows:

$$T = \begin{cases} p(h^{el} + h^{le}) + (q-p)h^{ee} & \text{Under express/local train alternative operation scheme} \\ (q-1)h^{ee} + (p-1)h^{ll} + h^{el} + h^{le} & \text{Under express train continuous departure scheme} \end{cases}. \quad (3)$$

3. The calculation method of line carrying capacity of regional rapid rail transit under mixed operation of express/local trains as claimed in claim 1, wherein the step 4 further comprises:

constraining express/local train departure interval time $h_{n_x}^{le}$ for overtaking station, wherein express/local train departure interval time $h_1^{le}$ for a starting station is changed;

performing a derivation process from the express/local train departure interval time $h_1^{le}$ for the starting station;

taking a first overtaking station as a capacity calculation control point, determining $h_{n_1}^{le}=h^{at}+h^{da}$ based on a compact running principle, and obtaining the express/local train departure interval time $h_1^{le}$ and express/local train departure interval time $h_{n_1}^{le}$ for the first overtaking station through a formula (6) expressed as follows:

$$h_{n_1}^{le} = h_1^{le} - \sum_{i=2}^{n_1-1} t_i^{st} - \sum_{j=1}^{n_1-1} \Delta t_j + h^{da}; \quad (6)$$

substituting $h_{n_1}^{le}=h^{at}+h^{da}$ into the formula (6) to thereby obtain a formula (7) expressed as follows:

$$h_1^{le} = h^{at} + \sum_{i=2}^{n_1-1} t_i^{st} + \sum_{j=1}^{n_1-1} \Delta t_j; \quad (7)$$

and obtaining express/local train mixed operation cycle time under taking the first overtaking station as the capacity calculation control point through a formula (8) expressed as follows:

$$T_{n_1} = qh^{dd} + (p-q)(t_{n_1}^{st} + h^{da}) + q\left(h^{at} + \sum_{i=2}^{n_1-1} t_i^{st} + \sum_{j=1}^{n_1-1} \Delta t_j\right). \quad (8)$$

4. The calculation method of line carrying capacity of regional rapid rail transit under mixed operation of express/local trains as claimed in claim 3, wherein in the step 4, in a situation that the overtaking station number is increased to 2, $h_{n_1}^{le}$ no longer only depends on $h^{at}$ and $h^{da}$, but also depends on express/local train departure interval time $h_{n_2}^{le}$ for a second overtaking station;

wherein the step 4 further comprises:

determining $h_{n_2}^{le}=h^{at}+h^{da}$ based on the compact running principle, and obtaining a formula (9) expressed as follows:

$$h_{n_2}^{le} = h_{n_1}^{le} - \sum_{i=n_1+1}^{n_2-1} t_i^{st} - \sum_{j=n_1}^{n_2-1} \Delta t_j + h^{da}; \quad (9)$$

substituting $h_{n_2}^{le}=h^{at}+h^{da}$ into the formula (9) to thereby obtain a formula (10) expressed as follows:

$$h_{n_1}^{le} = h^{at} + \sum_{i=n_1+1}^{n_2-1} t_i^{st} + \sum_{j=n_1}^{n_2-1} \Delta t_j; \quad (10)$$

and performing an iterating process on $h_{n_1}^{le}$ and thereby obtaining express/local train mixed operation cycle time under taking the second overtaking station as the capacity calculation control point through a formula (11) expressed as follows:

$$T_{n_2} = qh_1^{le} + (p-q)(t_{n_2}^{st} + h^{da}) + + q\left(h^{at} + \sum_{i=2}^{n_1-1} t_i^{st} + \sum_{j=1}^{n_1-1} \Delta t_j + \sum_{i=n_1+1}^{n_2-1} t_i^{st} + \sum_{j=n_1}^{n_2-1} \Delta t_j - h^{da}\right). \quad (11)$$

5. The calculation method of line carrying capacity of regional rapid rail transit under mixed operation of express/local trains as claimed in claim 4, wherein in the step 4, in a situation that the overtaking station number is increased to x, express/local train departure interval time $h_{n_1}^{le}$, $h_{n_2}^{le}$, . . . , $h_{n_{x-1}}^{le}$ are affected;

wherein the step 4 further comprises:

performing mathematical induction based on a derivation process to determine $h_{n_x}^{le}=h^{at}+h^{da}$, and obtaining a relationship between $h_{n_x}^{le}$ and $h_{n_{x-1}}^{le}$ through a formula (12) expressed as follows:

$$h_{n_x}^{le} = h_{n_{x-1}}^{le} - \sum_{i=n_{x-1}+1}^{n_x-1} t_i^{st} - \sum_{j=n_{x-1}}^{n_x-1} \Delta t_j + h^{da}; \quad (12)$$

repeatedly performing an iterating process from $h_{n_{x-1}}^{le}$ to $h_1^{le}$ to thereby obtain express/local train mixed operation cycle time under taking an x-th overtaking station as the capacity calculation control point through a formula (13) expressed as follows:

$$T_{n_x} = qh_1^{le} + (p-q)\left(t_{n_x}^{st} + h^{da}\right) + + q\left[h^{at} + \sum_{i=2}^{n_1-1} t_i^{st} + \sum_{j=1}^{n_1-1} \Delta t_j + \ldots + \sum_{i=n_{x-1}+1}^{n_x-1} t_i^{st} + \sum_{j=n_{x-1}}^{n_x-1} \Delta t_j - (x-1)h^{da}\right]; \quad (13)$$

determining a minimum control point cycle function $f_x(W, n_x)$ expressed in a formula (14):

$$f_x(W, n_x) = h^{at} + \sum_{i=2}^{n_x} t_i^{st} + \sum_{j=1}^{n_x-1} \Delta t_j - \sum_{n_x \in W} t_{n_x}^{st} - (x-1)h^{da}; \quad (14)$$

in a situation that multiple overtaking stations are set on the line, comparing carrying capacities of the multiple overtaking stations to determine a control point affecting the line carrying capacity; and calculating the express/local train mixed operation cycle time $T_c$ under the express/local train mixed operation mode according to a formula (15) expressed as follows:

$$T_c = \max\{T_{n_x}\} = \max\{qh^{dd} + (p-q)(t_{n_x}^{st} + h^{da}) + qf_x(W, n_x)\} \quad (15).$$

6. The calculation method of line carrying capacity of regional rapid rail transit under mixed operation of express/local trains as claimed in claim 1, wherein an express train stop position divided into four categories: stopping at a second station or an (m−1)-th station; stopping at a front or back station of an overtaking station; stopping at the overtaking station; stopping at other intermediate station;

wherein the calculation method further comprises: based on the express train stop position, introducing a cycle time calculation correction term g(i) considering the express train stop position.

7. The calculation method of line carrying capacity of regional rapid rail transit under mixed operation of express/local trains as claimed in claim 6, further comprising: in a situation that the category of the express train stop position is stopping at the second station or the (m−1)-th station, deriving express/local train mixed operation cycle time T' according to express/local train mixed operation cycle time T under a situation of express train not stopping at the intermediate station, wherein under a situation of express train not stopping at the intermediate station, the capacity calculation control point depends on express/local train departure interval time $h^{dd}$ at a starting station and express/local train arrival interval time $h^{ll}$ at a terminal station, and the express/local train mixed operation cycle time T under a situation of express train not stopping at the intermediate station is $$T = h^{dd} + h^{aa} + \sum_{i=2}^{m-1} t_i^{st} + \sum_{j=1}^{m-1} \Delta t_j;$$

wherein in a situation that the category of the express train stop position is stopping at the second station, the express/local train departure interval time $h^{dd}$ at the starting station is changed to express/local train departure-arrival interval time $h^{da}$ at the second station, the express/local train mixed operation cycle time T' is $$T' = h^{da} + \sum_{i=2}^{m-1} t_i^{st} + \sum_{j=2}^{m-1} \Delta t_j + h^{aa},$$

and $g(2) = T' - T = h^{da} - h^{dd} - \Delta t_1$;

wherein in a situation that the category of the express train stop position is stopping at the (m−1)-th station, the express/local train arrival interval time $h^{aa}$ at the terminal station is changed to express/local train departure-arrival interval time $h^{da}$ at the (m−1)-th station, the express/local train mixed operation cycle time T' is $$T' = h^{da} + \sum_{i=2}^{m-1} t_i^{st} + \sum_{j=1}^{m-2} \Delta t_j + h^{dd},$$

and $g(m-1) = T' - T = h^{da} - h^{aa} - \Delta t_{m-2}$.

8. The calculation method of line carrying capacity of regional rapid rail transit under mixed operation of express/local trains as claimed in claim 6, further comprising:

in a situation that the category of the express train stop position is stopping at the overtaking station, determining express/local train mixed operation cycle time T' by subtracting express/local train arrival-through interval time $h^{at}$ at an $n_x$-th station and express/local train through-departure interval time $h^{td}$ at the $n_x$-th station from express/local train mixed operation cycle time T under a situation of express train not stopping at the intermediate station, and adding express/local train departure interval time $h^{dd}$ at the $n_x$-th station, express/local train arrival interval time $h^{aa}$ at the $n_x$-th station, and express train stop interval time $t_{n_x}^{se}$ at the $n_x$-th station, thereby obtaining $T' = T - (h^{at} + h^{td}) + (h^{aa} + h^{dd} + t_{n_x}^{se})$ and $g(n_x) = T' - T = (h^{aa} + h^{dd} + t_{n_x}^{se}) - (h^{at} + h^{td})$.

9. The calculation method of line carrying capacity of regional rapid rail transit under mixed operation of express/local trains as claimed in claim 6, further comprising:

in a situation that the category of the express train stop position is stopping at the $(n_x-1)$-th station or an $(n_x+1)$-th station, determining express/local train mixed operation cycle time T' by subtracting express/local train arrival-through interval time $h^{at}$ at an $n_x$-th station and an express/local train operation time difference $\Delta t_{n_x-1}$ at an $(n_x-1)$-th section from express/local train mixed operation cycle time T under a situation of express train not stopping at the intermediate station, and adding express/local train departure-arrival interval time $h^{da}$ at the $(n_x-1)$-th station, thereby obtaining $T' = T - h^{at} - \Delta t_{n_x-1} + h^{da} + t_{n_x-1}$ and $g(n_x-1) = T' - T = h^{da} - h^{at} + t_{n_x-1} - \Delta t_{n_x-1}$.

10. The calculation method of line carrying capacity of regional rapid rail transit under mixed operation of express/local trains as claimed in claim 6, further comprising:

in a situation that the category of the express train stop position is stopping at other intermediate station, determining express/local train mixed operation cycle time T' by subtracting total express train stop interval time $\Sigma t_i^{se}$ from express/local train mixed operation cycle time T under a situation of express train not stopping at the intermediate station, thereby obtaining $T'=T-\Sigma t_i^{se}$ and $g(i)=-\Sigma t_i^{se}$.

11. A calculation method of line carrying capacity of regional rapid rail transit under mixed operation of express/local trains, comprising:

step 1, inputting basic parameters, wherein the basic parameters comprise:

line parameters, comprising: a station number m of stations; a station serial number i of each station; an overtaking station serial number $n_x$; an overtaking station serial number set W, which satisfies $n_x \in W$; and an overtaking station number x, which is a total number of an overtaking station in the overtaking station serial number set W;

operation scheme parameters, comprising: an express train number q, a local train number p, a ratio q:p of express/local trains, and an express/local train mixed operation mode; and time parameters, comprising: minimum arrival-through interval time $h^{at}$; minimum through-departure interval time $h^{td}$; minimum departure-arrival interval time $h^{da}$; minimum arrival interval time $h^{aa}$; minimum departure interval time $h^{dd}$; an express/local train operation time difference $\Delta t_j$ at a j-th section; local train stop interval time $t_i^{st}$ at a station i; and express train stop interval time $t_i^{se}$ at the station i;

step 2, selecting the express/local train mixed operation mode as an express/local train following operation mode or an express/local train alternatively running and overtaking operation mode; and in response to the selection of the express/local train following operation mode, performing step 3, or in response to the selection of the express/local train alternatively running and overtaking operation mode, performing step 4;

step 3, determining whether an express/local train operation scheme under the express/local train following operation mode is an express/local train alternative operation scheme or an express train continuous departure scheme; and in response to the express/local train operation scheme being the express/local train alternative operation scheme, performing step 3.1, or in response to the express/local train operation scheme being the express train continuous departure scheme, performing step 3.2;

step 3.1, calculating express/local train mixed operation cycle time $T_a$ according to a formula (4) expressed as follows, and performing step 5, $$T_a = \begin{cases} q\left(h^{aa}+h^{dd}\right)+(p-q)h^{da}+ q\left(\sum_{i=2}^{m-1} t_i^{st}+\sum_{j=1}^{m-1}\Delta t_j\right)+(p-q)t_{m-1}^{st} & \text{when } 1 \le q \le p \\ ph^{aa}+qh^{dd}+p\left(\sum_{i=2}^{m-1} t_i^{st}+\sum_{j=1}^{m-1}\Delta t_j\right) & \text{when } 1 \le p < q \end{cases}; \quad (4)$$

step 3.2, calculating express/local train mixed operation cycle time $T_b$ according to a formula (5) expressed as follows, and performing step 5, $$T_b = qh^{dd}+(p-1)h^{da}+h^{aa}+\sum_{i=2}^{m-1} t_i^{st}+\sum_{j=1}^{m-1}\Delta t_j+(p-1)t_{m-1}^{st}; \quad (5)$$

step 4, determining the overtaking station number x according to the overtaking station serial number set W under the express/local train alternatively running and overtaking operation mode; and in response to the overtaking station number x being less than 4, performing step 4.1; or in response to the overtaking station number x being not less than 4, performing step 4.2;

step 4.1, calculating express/local train mixed operation cycle time $T_c$ according to a formula (15) expressed as follows, and performing step 5, $$T_c=\max\{T_{n_x}\}=\max\{qh^{dd}+(p-q)(t_{n_x}^{st}+h^{da})+qf_x(W,n_x)\} \quad (15);$$

step 4.2, dividing a line into multiple sections according to objective factors comprising line condition, an overtaking station position, and train routing, to make an overtaking station number in each section of the multiple sections be not larger than three, wherein dividing of the multiple sections follows principles of less division times and balanced division; and performing step 4.1;

step 5, determining whether an express train stops or not at an intermediate station according to the line parameters; in response to the express train only stopping at starting and terminal stations, taking the express/local train mixed operation cycle time as final express/local train mixed operation cycle time, performing step 7; or in response to the express train stopping at the intermediate station, performing step 6;

step 6, correcting the calculated express/local train mixed operation cycle time based on an express train stop position according to a formula (16) expressed as follows, to obtain corrected express/local train mixed operation cycle time as final express/local train mixed operation cycle time; and performing step 7, $$g(i) = \begin{cases} h^{da}-h^{dd}-\Delta t_1,\ i=2 \\ h^{da}-h^{aa}-\Delta t_{m-2},\ i=m-1 \\ \left(h^{aa}+h^{dd}+t_{n_1}^{se}\right)-\left(h^{at}+h^{td}\right),\ i=n_x \\ h^{da}-h^{at}+t_{n_1-1}^{se}-\Delta t_{n_1-1},\ i=n_x-1 \\ h^{da}-h^{td}+t_{n_1+1}^{se}-\Delta t_{n_1},\ i=n_x+1 \\ -\sum t_i^{se},\ i \text{ for other values} \end{cases}; \quad (16)$$

step 7, calculating, based on the final express/local train mixed operation cycle time, the line carrying capacity under the express/local train mixed operation mode according to a formula (1):

$$N=3600(p+q)/T \quad (1); \text{ and}$$

step 8, designing, based on the line carrying capacity, the line, to thereby operate express and local trains in the designed line.

* * * * *